US009755326B2

(12) United States Patent
Kitagawa et al.

(10) Patent No.: US 9,755,326 B2
(45) Date of Patent: Sep. 5, 2017

(54) CRIMP TERMINAL AND TERMINAL CRIMPING DEVICE

(71) Applicants: YAZAKI CORPORATION, Tokyo (JP); TOYOTA JIDOSHA KABUSHIKI KAISHA, Toyota-shi, Aichi-ken (JP)

(72) Inventors: Hironori Kitagawa, Shizuoka (JP); Kei Sato, Shizuoka (JP); Hiroshi Aoki, Shizuoka (JP); Hiroshi Kobayashi, Okazaki (JP); Hiroyasu Taga, Toyota (JP); Motoya Hara, Nisshin (JP)

(73) Assignees: YAZAKI CORPORATION, Minato-ku, Tokyo (JP); TOYOTA JIDOSHA KABUSHIKI KAISHA, Toyota-Shi, Aichi-ken (JP)

( * ) Notice: Subject to any disclaimer, the term of this patent is extended or adjusted under 35 U.S.C. 154(b) by 0 days.

(21) Appl. No.: 15/375,273

(22) Filed: Dec. 12, 2016

(65) Prior Publication Data

US 2017/0179614 A1 Jun. 22, 2017

(30) Foreign Application Priority Data

Dec. 16, 2015 (JP) ..... 2015-244870

(51) Int. Cl.
*H01R 4/10* (2006.01)
*H01R 4/18* (2006.01)
*H01R 43/048* (2006.01)

(52) U.S. Cl.
CPC ..... *H01R 4/185* (2013.01); *H01R 4/188* (2013.01); *H01R 43/048* (2013.01)

(58) Field of Classification Search
CPC ..... H01R 4/185; H01R 4/188
USPC ..... 439/877
See application file for complete search history.

(56) References Cited

U.S. PATENT DOCUMENTS 5,671,528 A 9/1997 Endo et al.
5,901,439 A 5/1999 Endo et al.
2013/0171873 A1* 7/2013 Kanda ..... H01R 13/6581 439/607.51

(Continued)

FOREIGN PATENT DOCUMENTS

JP 08-222343 A 8/1996
JP 2012-069449 A 4/2012

(Continued)

*Primary Examiner* — Tho D Ta
*Assistant Examiner* — Nader Alhawamdeh
(74) *Attorney, Agent, or Firm* — Sughrue Mion, PLLC

(57) ABSTRACT

A crimp terminal includes a terminal connecting portion, an electric wire connecting portion, and a coupling portion. The electric wire connecting portion is divided into a bottom placed on a recessed surface of a first die and on which an end of an electric wire is placed during the crimping process, a first barrel piece extending from a first end of the bottom and wound around the end of the electric wire, and a second barrel piece extending from a second end of the bottom and wound around the end of the electric wire. The bottom has a recess formed on an outer wall surface on the recessed surface side and into which a protrusion formed on the recessed surface is inserted during the crimping process, and a protrusion on an inner wall surface formed along with formation of the recess.

11 Claims, 20 Drawing Sheets

(56) References Cited

U.S. PATENT DOCUMENTS

| | | | | |
|---|---|---|---|---|
| 2014/0033520 | A1* | 2/2014 | Nakagishi | H01R 43/048 29/753 |
| 2014/0317922 | A1* | 10/2014 | Schmidt | H01R 13/422 29/863 |
| 2015/0017833 | A1* | 1/2015 | Sato | H01R 4/184 439/519 |
| 2015/0357722 | A1* | 12/2015 | Sato | H01R 13/5216 439/877 |
| 2016/0006164 | A1 | 1/2016 | Sato | |

FOREIGN PATENT DOCUMENTS

| | | | |
|---|---|---|---|
| JP | 2014-160591 | A | 9/2014 |
| JP | 2014-182957 | A | 9/2014 |
| JP | 2014-182958 | A | 9/2014 |
| WO | 2014/148381 | A1 | 9/2014 |

* cited by examiner

CRIMP TERMINAL AND TERMINAL CRIMPING DEVICE

CROSS-REFERENCE TO RELATED APPLICATION(S)

The present application claims priority to and incorporates by reference the entire contents of Japanese Patent Application No. 2015-244870 filed in Japan on Dec. 16, 2015.

BACKGROUND OF THE INVENTION

1. Field of the Invention

The present invention relates to a crimp terminal and a terminal crimping device.

2. Description of the Related Art

Conventionally known are crimp terminals including an electric wire connecting portion electrically connected to a core wire of an electric wire. Such a crimp terminal and an electric wire are crimped by a terminal crimping device, thereby being electrically connected to each other. To increase the adhesion strength between an exposed core wire and an electric wire connecting portion, crimp terminals of this kind have the following shape. The crimp terminals described in Japanese Patent Application Laid-open No. 2014-182957 and Japanese Patent Application Laid-open No. 2014-182958, for example, each have a saw-toothed serration part on the inner wall surface of an electric wire connecting portion. The crimp terminal described in Japanese Patent Application Laid-open No. 2014-160591 has an uneven surface portion composed of a plurality of recesses and protrusions on the inner wall surface of an electric wire connecting portion. The crimp terminal described in Japanese Patent Application Laid-open No. 2012-69449 has a serration part composed of a plurality of grooves on the inner wall surface of an electric wire connecting portion. The serration parts and the uneven surface portion increases the contact area between the electric wire connecting portion and the core wire, thereby increasing the adhesion strength therebetween. The terminal crimping device described in Japanese Patent Application Laid-open No. H08-222343 thrusts an auxiliary punch against an electric wire connecting portion after completion of crimping, thereby forming a protrusion thrusted into a core wire inside the crimp terminal. The terminal crimping device thus increases the adhesion strength between the electric wire connecting portion and the core wire.

The adhesion strength between the electric wire connecting portion and the core wire affects the relation of electrical connection therebetween. As the adhesion strength increases, the electrical connection is improved. For this reason, crimp terminals need to secure the adhesion strength. To increase the adhesion strength, however, the number of manufacturing processes is increased as described in Japanese Patent Application Laid-open No. H08-222343, for example. As a result, the cost may possibly increase.

SUMMARY OF THE INVENTION

The present invention aims to provide a crimp terminal and a terminal crimping device that have high productivity and can secure the adhesion strength between an electric wire connecting portion and a core wire.

In order to achieve the above mentioned object, a crimp terminal according to one aspect of the present invention includes a terminal connecting portion electrically connected to a counterpart terminal; an electric wire connecting portion electrically connected to an end of an electric wire placed on an inner wall surface side by crimping process performed with the electric wire connecting portion sandwiched between a first die and a second die; and a coupling portion that couples the terminal connecting portion and the electric wire connecting portion, wherein the electric wire connecting portion is divided into a bottom placed on a recessed surface of the first die and on which the end of the electric wire is placed during the crimping process, a first barrel piece extending from a first end of the bottom and wound around the end of the electric wire, and a second barrel piece extending from a second end of the bottom and wound around the end of the electric wire, and the bottom has, in an area on which a core wire at a distal end of the electric wire is placed, a recess formed on an outer wall surface on the recessed surface side and into which a protrusion formed on the recessed surface is inserted during the crimping process, and a protrusion on the inner wall surface formed along with formation of the recess.

According to another aspect of the present invention, in the crimp terminal, it is desirable that the recess and the protrusion on the bottom and the protrusion on the recessed surface are formed into respective shapes such that the protrusion on the bottom protrudes from the inner wall surface of the bottom even when the core wire compresses the protrusion on the bottom during the crimping process.

According to still another aspect of the present invention, in the crimp terminal, it is desirable that a size of an internal space of the recess is smaller than a size of the protrusion on the recessed surface so that the protrusion on the recessed surface is capable of being thrusted into the recess during the crimping process, to push out the protrusion on the bottom toward the core wire side.

According to still another aspect of the present invention, in the crimp terminal, it is desirable that the recess and the protrusion on the bottom are formed in a core wire holding area on which the core wire is held when the core wire holding area is formed on the inner wall surface of the bottom.

In order to achieve the above mentioned object, a terminal crimping device according to still another aspect of the present invention includes a terminal supplying device that transfers a crimp terminal to a crimping position at which the crimp terminal is crimped to an electric wire; a crimping device that crimps the crimp terminal transferred to the crimping position to an end of the electric wire using a first die and a second die; and a driving device that reduces a gap between the first die and the second die during crimping process and increases the gap between the first die and the second die after the crimping process is completed, wherein the crimp terminal includes a terminal connecting portion electrically connected to a counterpart terminal, an electric wire connecting portion electrically connected to the end of the electric wire placed on an inner wall surface side by the crimping process, and a coupling portion that couples the terminal connecting portion and the electric wire connecting portion, the electric wire connecting portion is divided into a bottom placed on a recessed surface of the first die and on which the end of the electric wire is placed during the crimping process, a first barrel piece extending from a first end of the bottom and wound around the end of the electric wire, and a second barrel piece extending from a second end of the bottom and wound around the end of the electric wire, and the bottom has, in an area on which a core wire at a distal end of the electric wire is placed, a recess formed on an outer wall surface on the recessed surface side and into which a protrusion formed on the recessed surface is inserted during the crimping process, and a protrusion on the inner wall surface formed along with formation of the recess.

According to still another aspect of the present invention, in the terminal crimping device, it is desirable that the recess and the protrusion on the bottom and the protrusion on the recessed surface are formed into respective shapes such that the protrusion on the bottom protrudes from the inner wall surface of the bottom even when the core wire compresses the protrusion on the bottom during the crimping process.

According to still another aspect of the present invention, in the terminal crimping device, it is desirable that a size of the protrusion on the recessed surface is larger than a size of an internal space of the recess so that the protrusion on the recessed surface is capable of being thrusted into the recess during the crimping process, to push out the protrusion on the bottom toward the core wire side.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
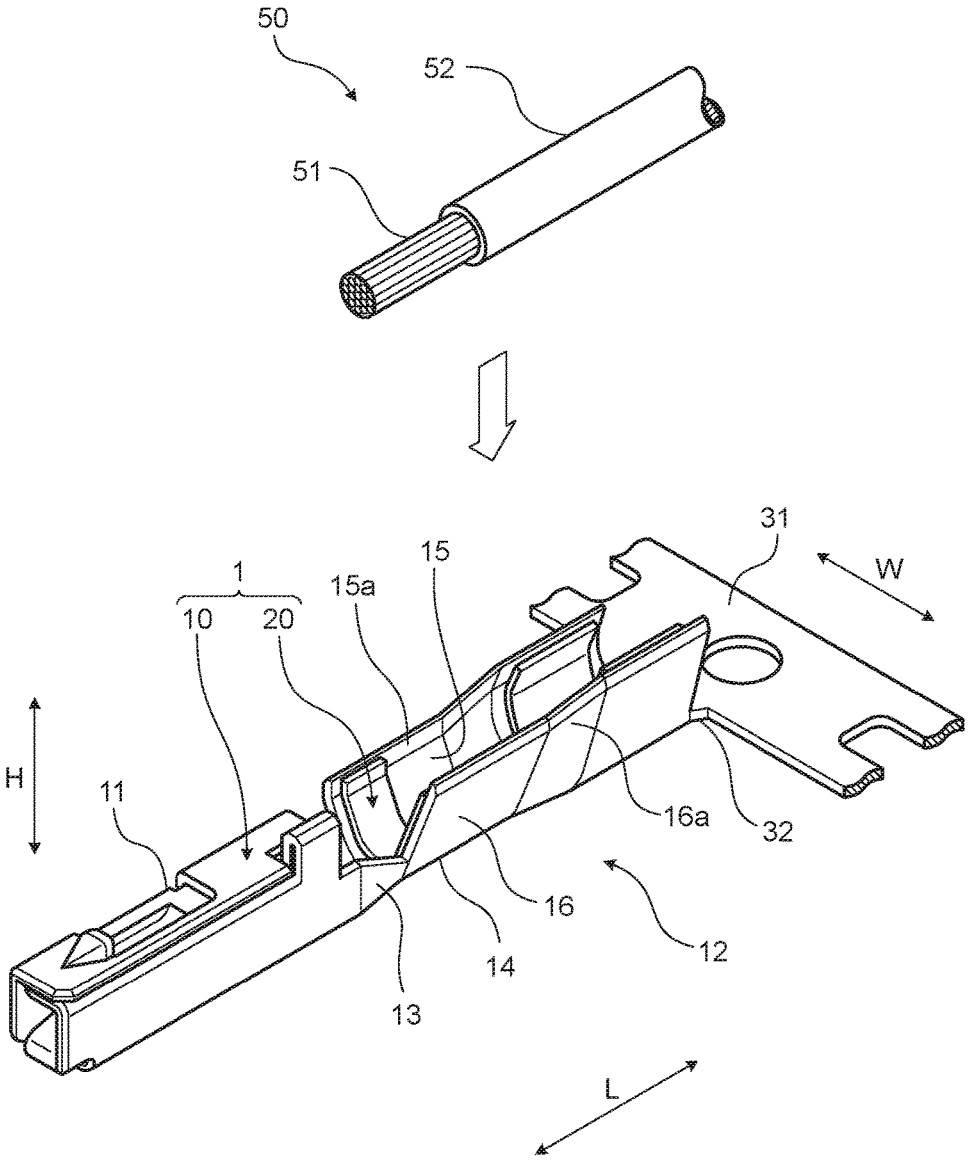
FIG. 1 is a perspective view of a crimp terminal according to an embodiment and illustrates a state where the crimp terminal is yet to be connected to an electric wire.
Figure 2:
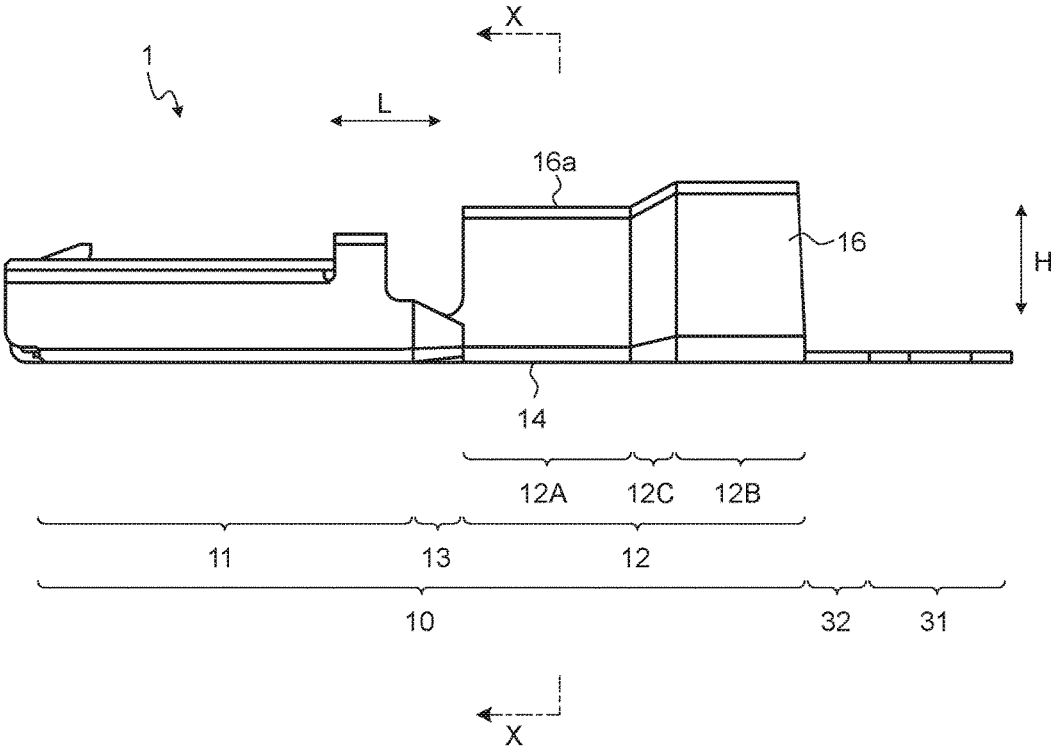
FIG. 2 is a side view of the crimp terminal according to the embodiment and illustrates a state where an electric wire connecting portion is formed into a U-shape.
Figure 3:
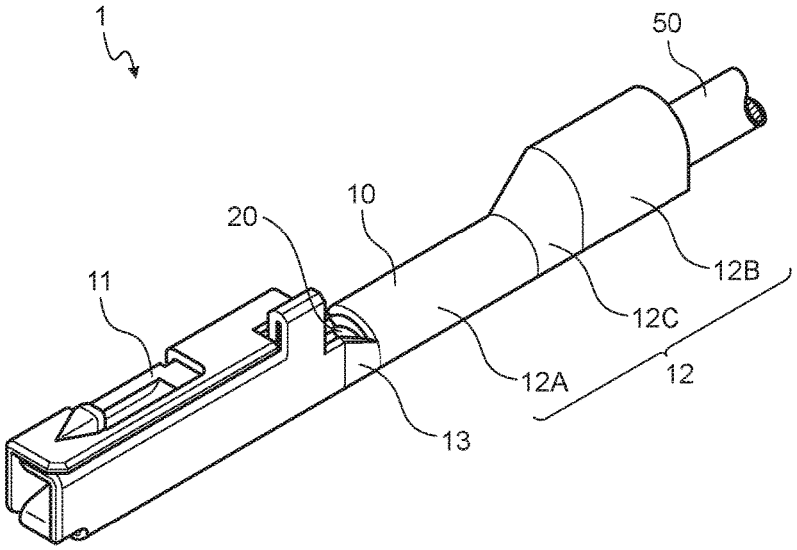
FIG. 3 is a perspective view of the crimp terminal after completion of crimping according to the embodiment.

Exemplary embodiments of a crimp terminal and a terminal crimping device according to the present invention are described below in greater detail with reference to the accompanying drawings. The embodiments are not intended to limit the invention.

Embodiments

An embodiment of the crimp terminal and the terminal crimping device according to the present invention is described with reference to FIGS. 1 to 25.

The crimp terminal according to the present embodiment is represented by reference numeral 1 in FIGS. 1 to 4. The crimp terminal 1 is electrically connected to an electric wire 50 and electrically connected to a counterpart terminal (not illustrated) while being integrated with the electric wire 50. At an end of the electric wire 50, a cover 52 is removed by a predetermined length so as to expose a core wire 51 by the predetermined length. The core wire 51 may be an aggregate of a plurality of wires or a solid wire, such as a coaxial cable. To electrically connect the crimp terminal 1 to the electric wire 50, the crimp terminal 1 is crimped to the end of the electric wire 50. As a result, the crimp terminal 1 is electrically connected to the core wire 51 at the exposed distal end (hereinafter, simply referred to as a "core wire at the distal end").

Specifically, the crimp terminal 1 includes a terminal fitting 10 and a water stop member 20.

Figure 5:
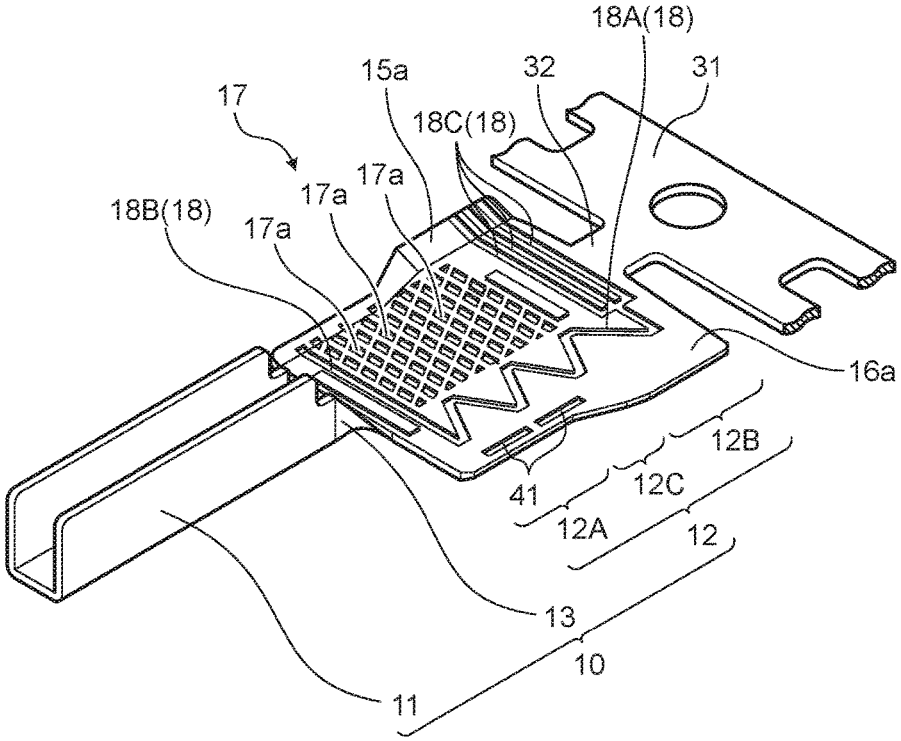
FIG. 5 is a perspective view of a terminal fitting of the crimp terminal according to the embodiment and illustrates a state where a water stop member is yet to be affixed.
Figure 6:
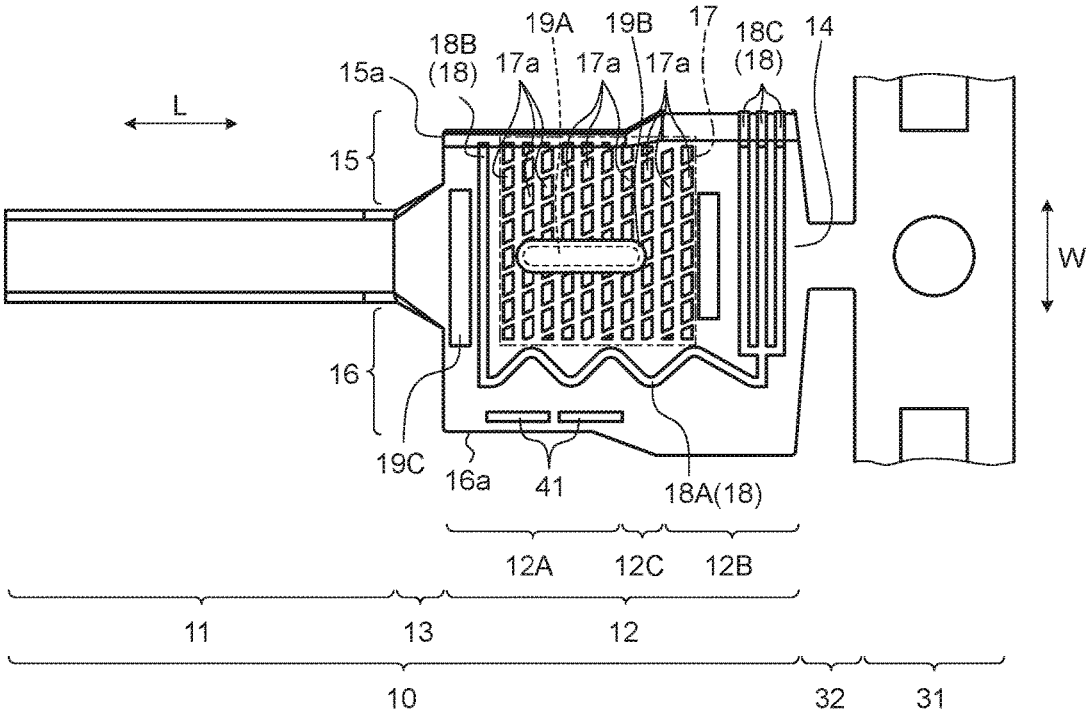
FIG. 6 is a top view of the terminal fitting of the crimp terminal according to the embodiment and illustrates a state where the water stop member is yet to be affixed.

The terminal fitting 10 is a main part of the crimp terminal 1. The terminal fitting 10 is made of a conductive metal plate (e.g., a copper plate) and formed into a predetermined shape that enables the terminal fitting 10 to be connected to the counterpart terminal and the electric wire 50. As illustrated in FIGS. 5 and 6, the terminal fitting 10 includes a terminal connecting portion 11 and an electric wire connecting portion 12. The terminal connecting portion 11 is electrically connected to the counterpart terminal. The electric wire connecting portion 12 is electrically connected to the electric wire 50. The terminal connecting portion 11 and the electric wire connecting portion 12 are coupled to each other by a coupling portion 13 provided therebetween.

The terminal fitting 10 may be a male terminal or female terminal. In a case where the terminal fitting 10 is a male terminal, the terminal connecting portion 11 is formed into a male shape. In a case where the terminal fitting 10 is a female terminal, the terminal connecting portion 11 is formed into a female shape. In the present embodiment, the terminal fitting 10 is a female terminal, for example.

In the crimp terminal 1, a connection direction (insertion direction) to the counterpart terminal is defined as a first direction L corresponding to a longitudinal direction. A parallel arrangement direction, which will be described later, of the crimp terminal 1 is defined as a second direction W corresponding to a width direction of the crimp terminal 1. In the crimp terminal 1, a direction orthogonal to the first direction L and the second direction W is defined as a third direction H corresponding to a height direction.

Figure 7:
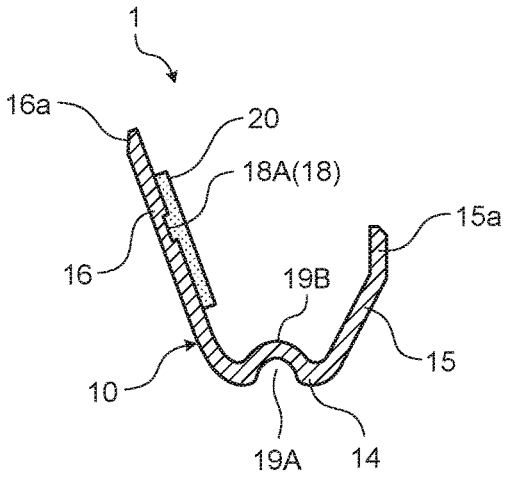
FIG. 7 is a view of a sectional part of the electric wire connecting portion along line X-X in FIG. 2.

The electric wire connecting portion 12 is formed into a plate shape first (FIGS. 5 and 6). The electric wire connecting portion 12 is subjected to predetermined processing, which will be described later, thereby being formed into a U-shape corresponding to a state just before being connected to the electric wire 50 (FIGS. 1 and 7). The electric wire connecting portion 12 is wound around the electric wire 50 with the end of the electric wire 50 placed thereon. The electric wire connecting portion 12 is thus crimped to the end of the electric wire 50, thereby coming into contact with the core wire 51 at the distal end.

The electric wire connecting portion 12 can be divided into an area of a bottom 14, an area of a first barrel piece 15, and an area of a second barrel piece 16. The bottom 14 is a part serving as a bottom wall of the U-shaped electric wire connecting portion 12. In crimping, the end of the electric wire 50 is placed on the bottom 14. The first barrel piece 15 and the second barrel piece 16 are parts serving as side walls of the U-shaped electric wire connecting portion 12. The first barrel piece 15 and the second barrel piece 16 extend at both ends of the bottom 14 in the second direction W. In the U-shaped electric wire connecting portion 12, the first barrel piece 15 and the second barrel piece 16 extend in a manner surrounding the end of the electric wire 50 from both ends of the bottom 14.

Figure 8:
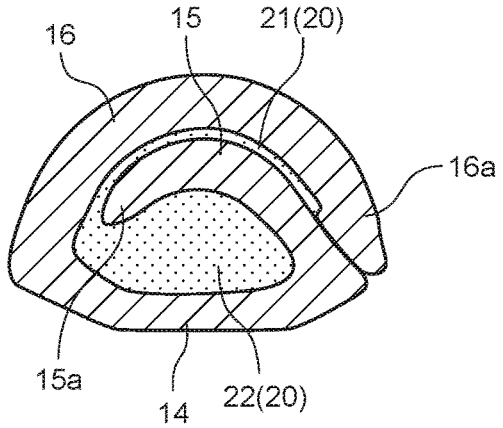
FIG. 8 is a view of a sectional part of the electric wire connecting portion along line Y1-Y1 in FIG. 4.
Figure 9:
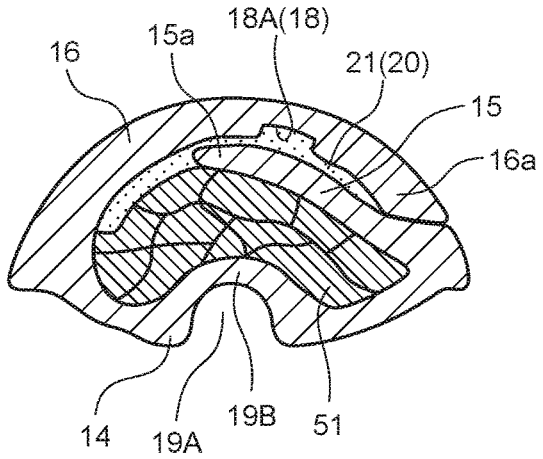
FIG. 9 is a view of a sectional part of the electric wire connecting portion along line Y2-Y2 in FIG. 4.
Figure 10:
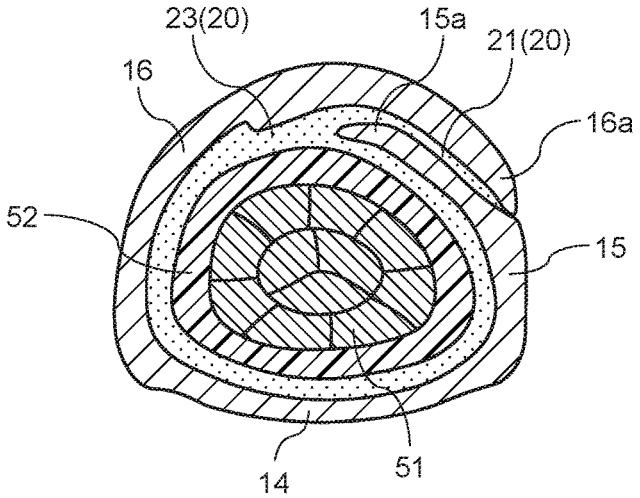
FIG. 10 is a view of a sectional part of the electric wire connecting portion along line Y3-Y3 in FIG. 4.

The first barrel piece 15 and the second barrel piece 16 are formed such that one of the lengths from the proximal ends of the bottom 14 to the end surfaces of a distal end 15*a* and a distal end 16*a* is longer than the other. With this structure, one of the distal ends 15*a* and 16*a* of the first barrel piece 15 and the second barrel piece 16, respectively, extends longer than the other in the third direction H in the U-shaped electric wire connecting portion 12. In this example, the second barrel piece 16 extends longer than the first barrel piece 15 from the bottom 14 (refer to FIGS. 1 and 7). With this structure, the electric wire connecting portion 12 has an area in which the first barrel piece 15 and the second barrel piece 16 overlap with each other (hereinafter, referred to as an "overlapping area") after crimping is completed (hereinafter, referred to as "after completion of crimping") (FIGS. 8 to 10). Specifically, the overlapping area is an area in which the outer wall surface of the first barrel piece 15 faces the inner wall surface of the second barrel piece 16 after completion of crimping. In other words, the first barrel piece 15 of the electric wire connecting portion 12 is wound around the end of the electric wire 50 on the inner side, and the second barrel piece 16 is wound around the end of the electric wire 50 on the outer side. In crimping, the first barrel piece 15 is wound around the outer periphery of the end of the electric wire 50, and the second barrel piece 16 is wound so as to cover the end of the electric wire 50 and the first barrel piece 15 from the outer periphery side. As described above, the first barrel piece 15 and the second barrel piece 16 of the electric wire connecting portion 12 are caulked to the end of the electric wire 50.

The end of the electric wire 50 is inserted into a U-shaped internal space from an opening of the U-shape of the electric wire connecting portion 12 (opening formed between the respective end surfaces of the distal ends 15*a* and 16*a*). To facilitate insertion of the end of the electric wire 50, the gap between the first barrel piece 15 and the second barrel piece 16 of the electric wire connecting portion 12 increases from the bottom 14 side to the opening side (the distal ends 15*a* and 16*a* side).

The electric wire connecting portion 12 can be further divided into an area of a core wire crimping portion 12A, an area of a cover crimping portion 12B, and an area of a coupling crimping portion 12C (FIGS. 2 and 4 to 6). The core wire crimping portion 12A is a part crimped to the core wire 51 at the distal end and coupled to the coupling portion 13. The cover crimping portion 12B is a part crimped to the cover 52 coupled to the proximal end of the exposed part of the core wire 51 at the distal end. The coupling crimping portion 12C is a part that couples the core wire crimping portion 12A and the cover crimping portion 12B and that is crimped to the end of the electric wire 50.

Figure 11:
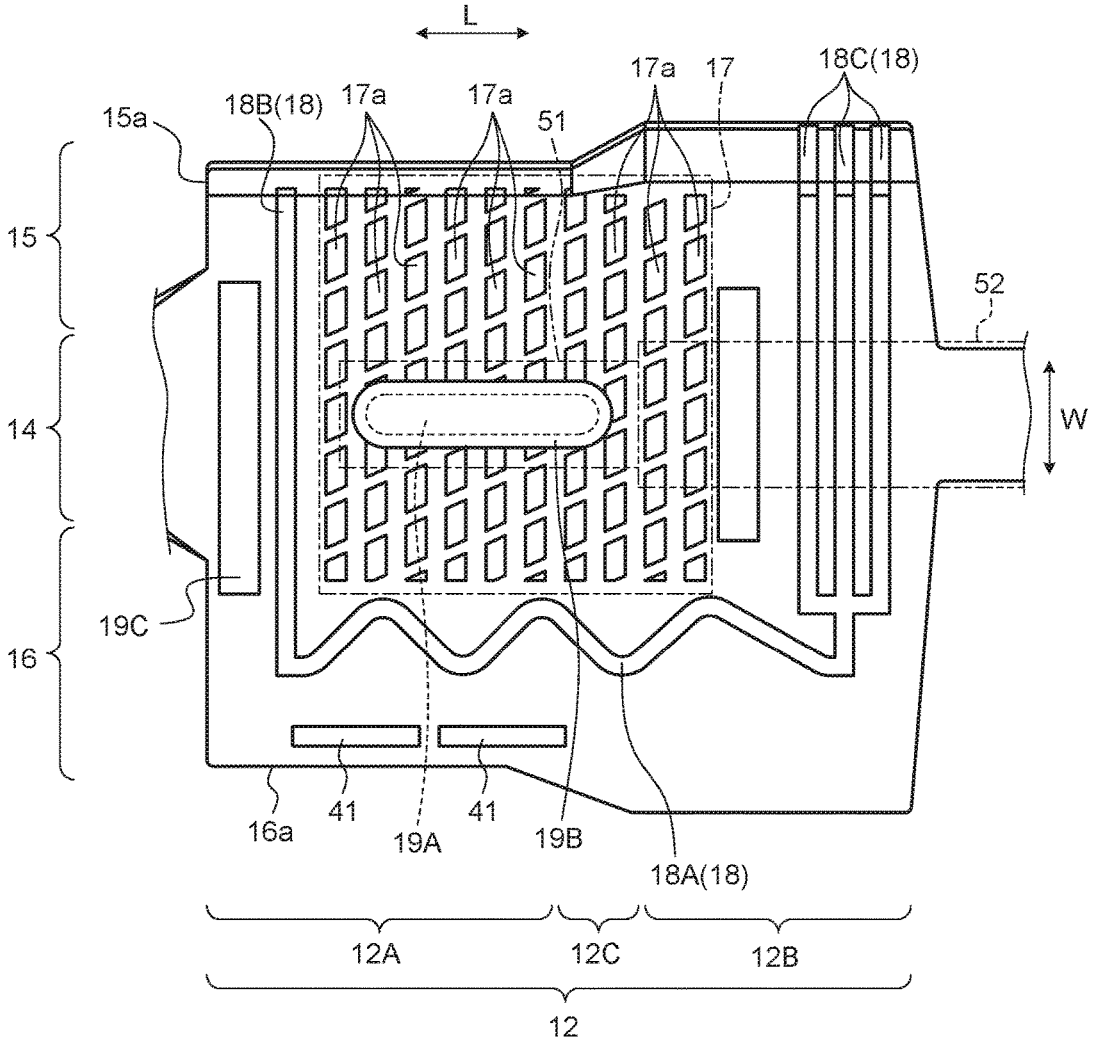
FIG. 11 is a view for explaining the electric wire connecting portion to which the water stop member is yet to be affixed.

The electric wire connecting portion 12 has a core wire holding area (hereinafter, referred to as a "serration area") 17 that holds the crimped core wire 51 at the distal end on its inner wall surface (wall surface that covers the electric wire 50) (FIG. 11). The serration area 17 is provided to at least a part wound around the core wire 51 at the distal end in the inner wall surface of the electric wire connecting portion 12. The serration area 17 in this example is formed so as to cover the entire core wire 51 at the distal end. The serration area 17 in the first direction L is formed between a part closer to the terminal connecting portion 11 than the distal end position of the core wire 51 at the distal end placed on the inner wall surface and a part on which the cover 52 is placed. The serration area 17 in the second direction W is formed between a part on the distal end 15*a* of the first barrel piece 15 and a part of the second barrel piece 16 that comes into contact with at least the core wire 51 at the distal end after completion of crimping. The serration area 17 in this example is provided to a part closer to the distal end 16*a* than the part that comes into contact with the core wire 51 at the distal end. Specifically, in the serration area 17 according to the present embodiment, a plurality of recesses, a plurality of protrusions, or a plurality of combinations of recesses and protrusions are arrayed in a rectangular shape. The recesses and the protrusions increase the contact area between the electric wire connecting portion 12 and the core wire 51 at the distal end and the adhesive strength therebetween. In this example, the rectangular serration area 17 is composed of a plurality of recesses 17*a*.

Figure 12:
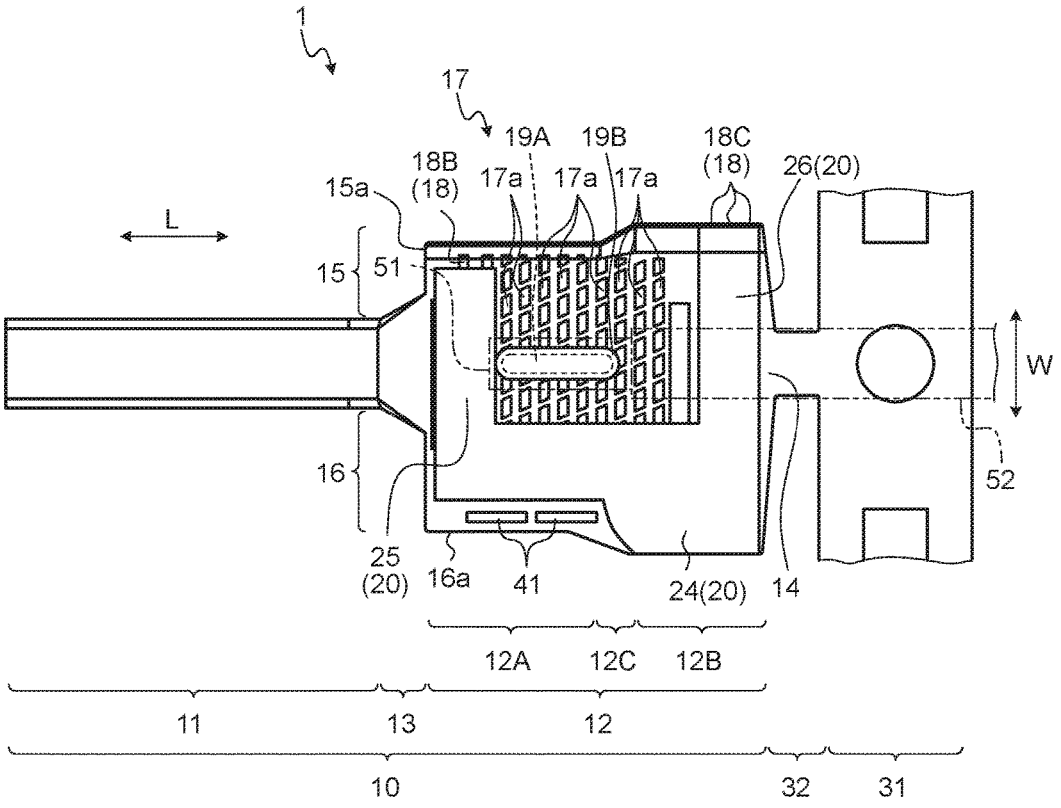
FIG. 12 is a top view of the crimp terminal according to the embodiment and illustrates a state where the water stop member is affixed.
Figure 13:
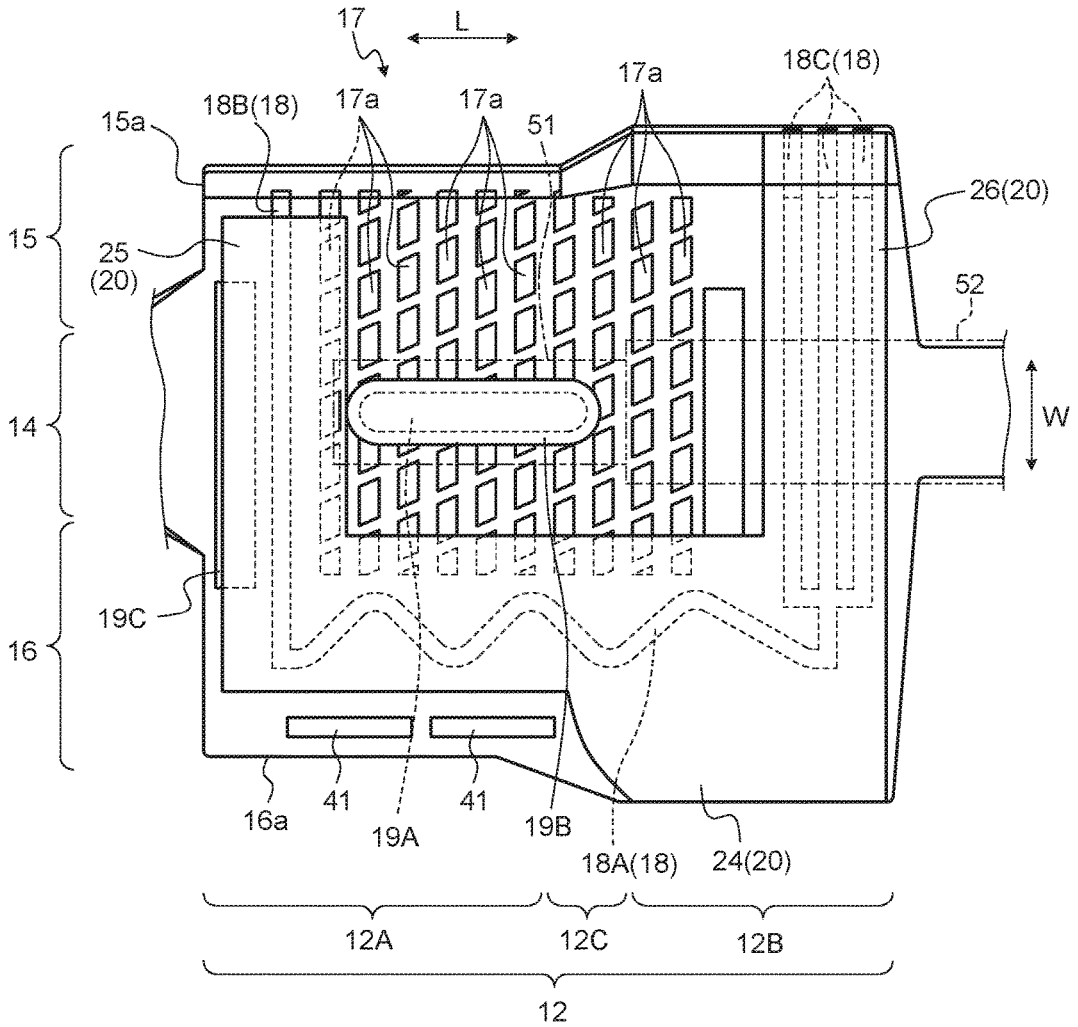
FIG. 13 is a view for explaining the electric wire connecting portion yet to be formed into a U-shape and the water stop member.

The electric wire connecting portion 12 and the core wire 51 at the distal end need to be electrically connected to each other. Entering of water therebetween is undesirable because it may possibly reduce the durability. Let us assume a case where the electric wire connecting portion 12 and the core wire 51 are made of different types of metal materials having different ionization tendencies (e.g., copper and aluminum), for example. In this case, entering of water therebetween may possibly cause corrosion especially in aluminum. To address this, the crimp terminal 1 is provided with the water stop member 20 that suppresses entering of water between the electric wire connecting portion 12 and the core wire 51 at the distal end (FIGS. 12 and 13). The water stop member 20 is a sheet-like member made mainly of an adhesive, such as a modified acrylic adhesive. The water stop member 20, for example, is a sheet-like nonwoven fabric impregnated with the adhesive and has an adhesive effect on both surfaces of the sheet.

The water stop member 20 has a first water stop area 21, a second water stop area 22, and a third water stop area 23 formed after completion of crimping (FIGS. 8 to 10). To embody the arrangement of the first to the third water stop areas 21 to 23, the water stop member 20 is formed into a predetermined shape and affixed to the inner wall surface of the plate-like electric wire connecting portion 12 illustrated in FIG. 6.

The first water stop area 21 is an area where the water stop member 20 is interposed between at least the outer wall surface of the first barrel piece 15 and the inner wall surface of the second barrel piece 16 (that is, the overlapping area) after completion of crimping (FIGS. 8 to 10). The first water stop area 21 suppresses entering of water between the electric wire connecting portion 12 and the core wire 51 at the distal end from the space between the outer wall surface and the inner wall surface. The first water stop area 21 extends between a part closer to the terminal connecting portion 11 than the distal end position of the core wire 51 at the distal end and a part closer to the cover 52 than the proximal end of the core wire 51 at the distal end. The first water stop area 21 is formed by a first water stop portion 24 of the water stop member 20 (FIG. 13).

The first water stop portion 24 is arranged between the distal end 16*a* of the second barrel piece 16 and the bottom 14. The first water stop portion 24 extends from a part closer to the terminal connecting portion 11 than the distal end position of the core wire 51 at the distal end and a part closer to the cover 52 than the proximal end of the core wire 51 at the distal end. The part of the first water stop portion 24 on the bottom 14 side extends to a position where it covers the part of the serration area 17 on the second barrel piece 16 side. With this structure, the first water stop area 21 in this example is formed not only in the overlapping area but also between the inner wall surface of the second barrel piece 16 and the core wire 51 at the distal end without interrupting electrical connection between the second barrel piece 16 and the core wire 51 at the distal end (FIG. 9).

The second water stop area 22 is an area filled with the water stop member 20 in at least the inner part of the electric wire connecting portion 12 formed after completion of crimping on the side closer to the terminal connecting portion 11 than the distal end position of the core wire 51 at the distal end (FIG. 8). The second water stop area 22 suppresses entering of water between the electric wire connecting portion 12 and the core wire 51 at the distal end from the terminal connecting portion 11 side. The second water stop area 22 is mainly formed by a second water stop portion 25 of the water stop member 20 (FIG. 13).

The second water stop portion 25 is arranged between the distal end 15*a* of the first barrel piece 15 and the first water stop portion 24. The second water stop portion 25 extends from a part closer to the terminal connecting portion 11 than the distal end position of the core wire 51 at the distal end and a part corresponding to the distal end of the core wire 51 at the distal end. The second water stop portion 25 in this example is arranged in a manner overlapping with the distal end of the core wire 51 at the distal end. With this structure, the second water stop area 22 in this example covers the distal end of the core wire 51 with the water stop member 20 (second water stop portion 25). The second water stop portion 25 in this example is connected to the first water stop portion 24. In other words, the second water stop area 22 in this example is formed by the second water stop portion 25 and the connection part of the first water stop portion 24 to the second water stop portion 25 (part closer to the bottom 14 than the overlapping area).

The third water stop area 23 is an area where the water stop member 20 is interposed between at least the inner wall surface of the electric wire connecting portion 12 (specifically, the cover crimping portion 12B) and the cover 52 after completion of crimping (FIG. 10). The third water stop area 23 suppresses entering of water between the electric wire connecting portion 12 and the core wire 51 at the distal end from the space between the inner wall surface and the cover 52. The third water stop area 23 is mainly formed by a third water stop portion 26 of the water stop member 20 (FIG. 13).

The third water stop portion 26 is arranged at a part wound around the cover 52 in the electric wire connecting portion 12 between the distal end 15*a* of the first barrel piece 15 and the first water stop portion 24. The third water stop portion 26 in this example is connected to the first water stop portion 24. In other words, the third water stop area 23 in this example is formed by the third water stop portion 26 and the connection part of the first water stop portion 24 to the third water stop portion 26 (part closer to the bottom 14 than the overlapping area).

The water stop member 20 having the shape described above is arranged on the inner wall surface of the electric wire connecting portion 12. With this structure, the water stop member 20 serves as the first to the third water stop areas 21 to 23 connected to one another after completion of crimping. The first to the third water stop areas 21 to 23 prevent the end of the electric wire 50 from communicating with the outside in the electric wire connecting portion 12. As a result, the water stop member 20 can suppress entering of water between the electric wire connecting portion 12 and the core wire 51 at the distal end.

The terminal fitting 10 described above is subjected to a pressing process performed on one metal plate, thereby being formed into the shape having the plate-like electric wire connecting portion 12 illustrated in FIG. 6. In the following water stop member affixing process, the water stop member 20 is affixed to the plate-like electric wire connecting portion 12. In the following folding process, the terminal connecting portion 11 and the U-shaped electric wire connecting portion 12 are formed in the terminal fitting 10.

Figure 14:
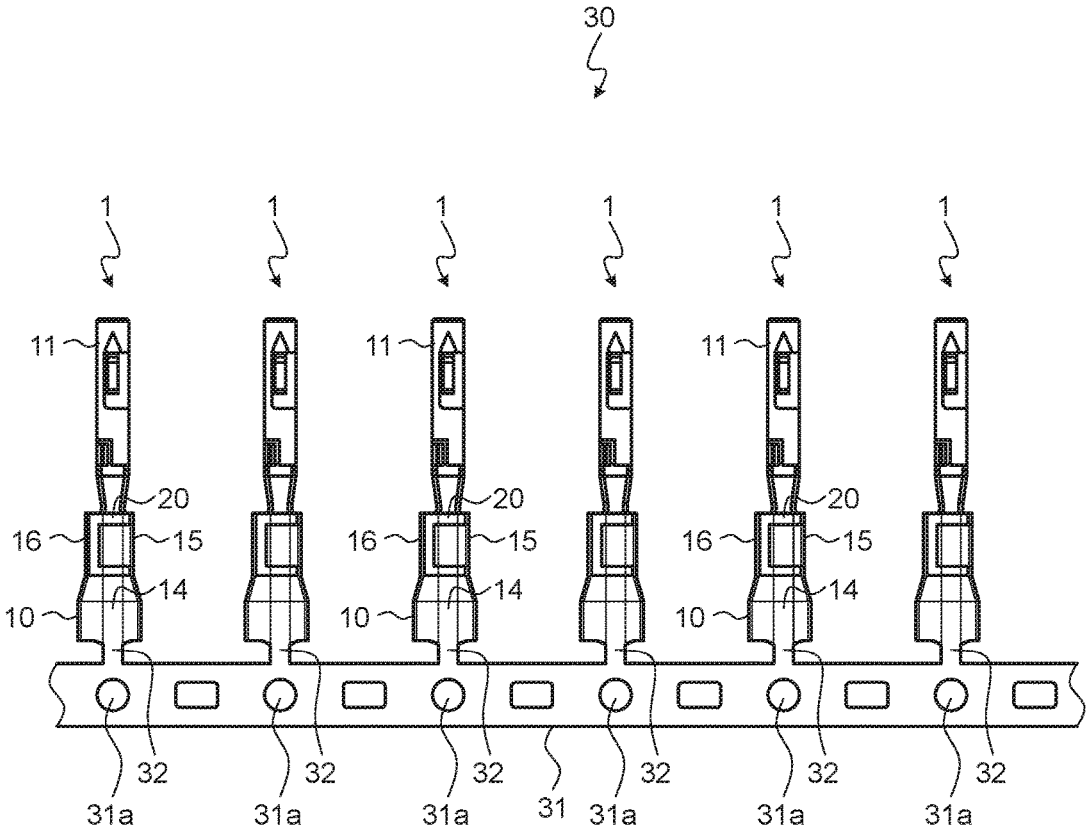
FIG. 14 is a view for explaining a terminal chain body.

A plurality of crimp terminals 1 subjected to the processes described above are arranged in line and formed into a chain body (hereinafter, referred to as a "terminal chain body") 30 (FIG. 14). The terminal chain body 30 is an aggregate of the crimp terminals 1 arranged in parallel at regular intervals with themselves facing the same direction and connected to one another in a chain shape. In the terminal chain body 30, one ends of all the crimp terminals 1 are connected by a connection piece 31. The connection piece 31 is formed into a rectangular plate shape, for example, and arranged with a predetermined gap interposed between the connection piece 31 and the electric wire connecting portions 12 of all the crimp terminals 1. The bottoms 14 of the electric wire connecting portions 12 are coupled to the connection piece 31 via rectangular plate-like coupling portions 32 of the respective crimp terminals 1, for example. The connection piece 31 has through holes (hereinafter, referred to as "terminal feeding holes") 31*a* formed at regular intervals in the feeding direction of the terminal chain body 30. The terminal feeding holes 31*a* are used to feed the terminal chain body 30 to the crimping position in a terminal crimping device 100. The terminal chain body 30 formed in this manner is placed in the terminal crimping device 100 in a manner wound like a reel (not illustrated). After being crimped to the electric wire 50, the crimp terminal 1 is cut off from the terminal chain body 30.

The following describes the terminal crimping device 100.

Figure 15:
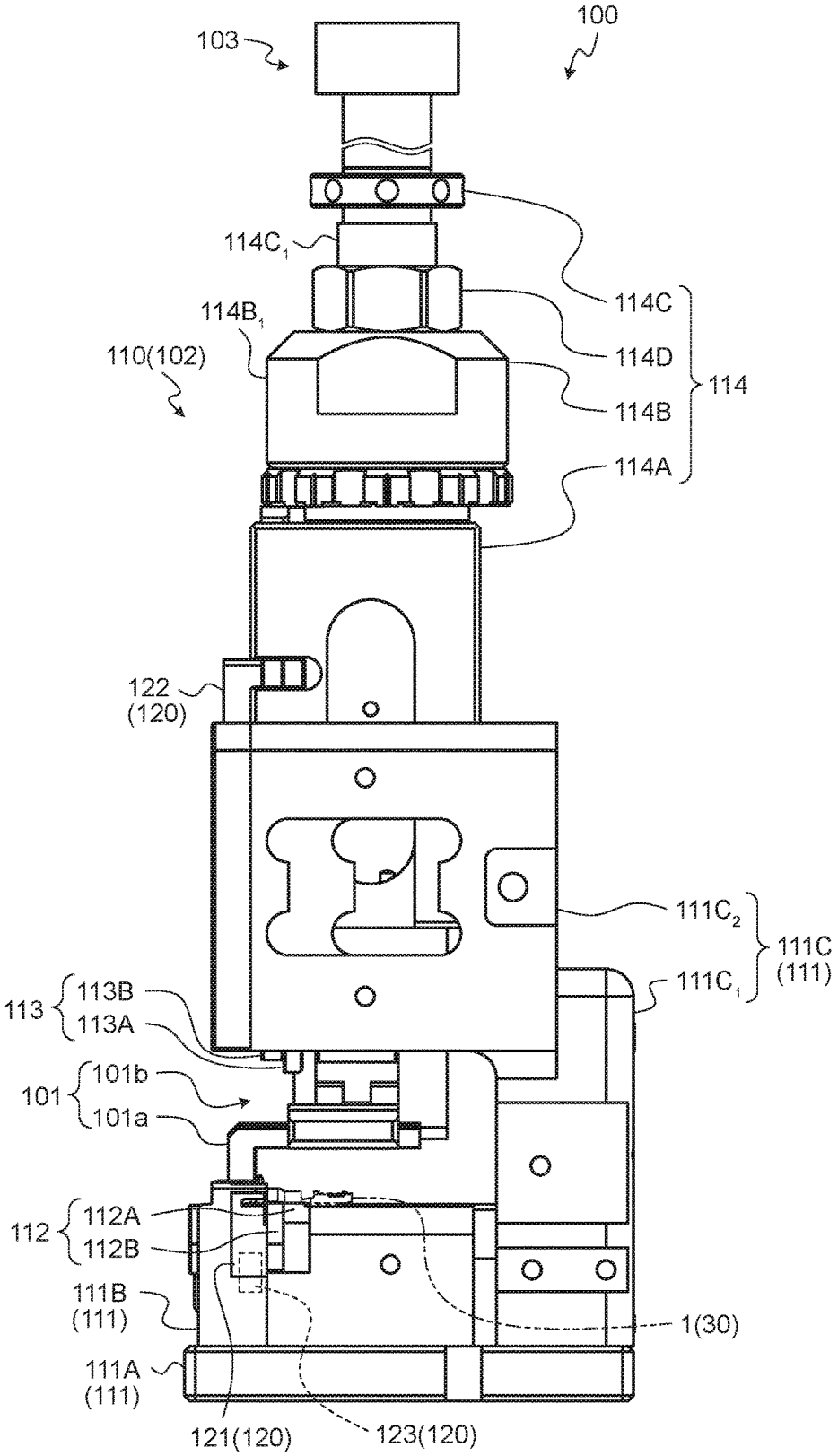
FIG. 15 is a view for explaining a terminal crimping device according to the embodiment.

As illustrated in FIG. 15, the terminal crimping device 100 includes a terminal supplying device 101, a crimping device 102, and a driving device 103. The terminal supplying device 101 transfers the crimp terminal 1 to a predetermined crimping position. The crimping device 102 crimps the crimp terminal 1 to the electric wire 50 at the crimping position. The driving device 103 operates the terminal supplying device 101 and the crimping device 102. The terminal supplying device 101 and the crimping device 102 are referred to as an applicator in this technical field.

The terminal supplying device 101 draws out the leading crimp terminal 1 positioned on the outer periphery of the terminal chain body 30 wound like a reel and sequentially transfers it to the crimping position. After finishing crimping the leading crimp terminal 1 to the electric wire 50 and cutting it off from the terminal chain body 30, the terminal supplying device 101 transfers another leading crimp terminal 1 to the crimping position. The terminal supplying device 101 sequentially repeats the operation described above every time it performs crimping and cutting.

The terminal supplying device 101 has a configuration publicly known in this technical field and includes a terminal feeding member 101*a* and a power transmission mechanism 101*b*. The terminal feeding member 101*a* is inserted into the terminal feeding hole 31*a* in the connection piece 31. The power transmission mechanism 101*b* drives the terminal feeding member 101*a* with the power of the driving device 103. The power transmission mechanism 101*b* serves as a link mechanism linked with a crimping operation (e.g., an up-and-down movement of a ram 114A, which will be described later) of the crimping device 102. The terminal supplying device 101 in this example is linked with the crimping operation of the crimping device 102 to drive the terminal feeding member 101*a* in the vertical direction and the horizontal direction. The terminal supplying device 101 thus transfers the crimp terminal 1 to the crimping position.

The crimping device 102 crimps the transferred crimp terminal 1 to the electric wire 50 and cuts off the crimp terminal 1 from the terminal chain body 30. The crimping device 102 includes a crimping machine 110 and a terminal cutting machine 120.

The crimping machine 110 is a device that caulks the crimp terminal 1 transferred to the crimping position to the end of the electric wire 50, thereby crimping the crimp terminal 1 to the electric wire 50. The crimping machine 110 in this example caulks the first barrel piece 15 and the second barrel piece 16 of the crimp terminal 1 to the core wire 51 at the distal end and the cover 52 of the electric wire 50, thereby crimping the crimp terminal 1 to the electric wire 50. The crimping machine 110 includes a frame 111, a pair of first die 112 and second die 113, and a power transmission mechanism 114.

The frame 111 includes a base 111A, an anvil support 111B, and a support (hereinafter, referred to as a "transmission unit support") 111C for the power transmission mechanism 114. The base 111A is fixed on a pedestal (not illustrated) on which the terminal crimping device 100 is placed, for example. The anvil support 111B and the transmission unit support 111C are fixed on the base 111A. The transmission unit support 111C is arranged behind (on the right side in the drawing in FIG. 15) and above (on the upper side in the drawing in FIG. 15) the anvil support 111B. Specifically, the transmission unit support 111C includes a standing portion 111$C_1$ and a ram support portion 111$C_2$. The standing portion 111$C_1$ is provided in a manner standing upward from the base 111A behind the anvil support 111B. The ram support portion 111$C_2$ is held by the upper part of the standing portion 111$C_1$. The ram support portion 111$C_2$ is a support that supports the ram 114A, which will be described later, and is arranged above the anvil support 111B with a predetermined gap interposed therebetween.

Figure 16:
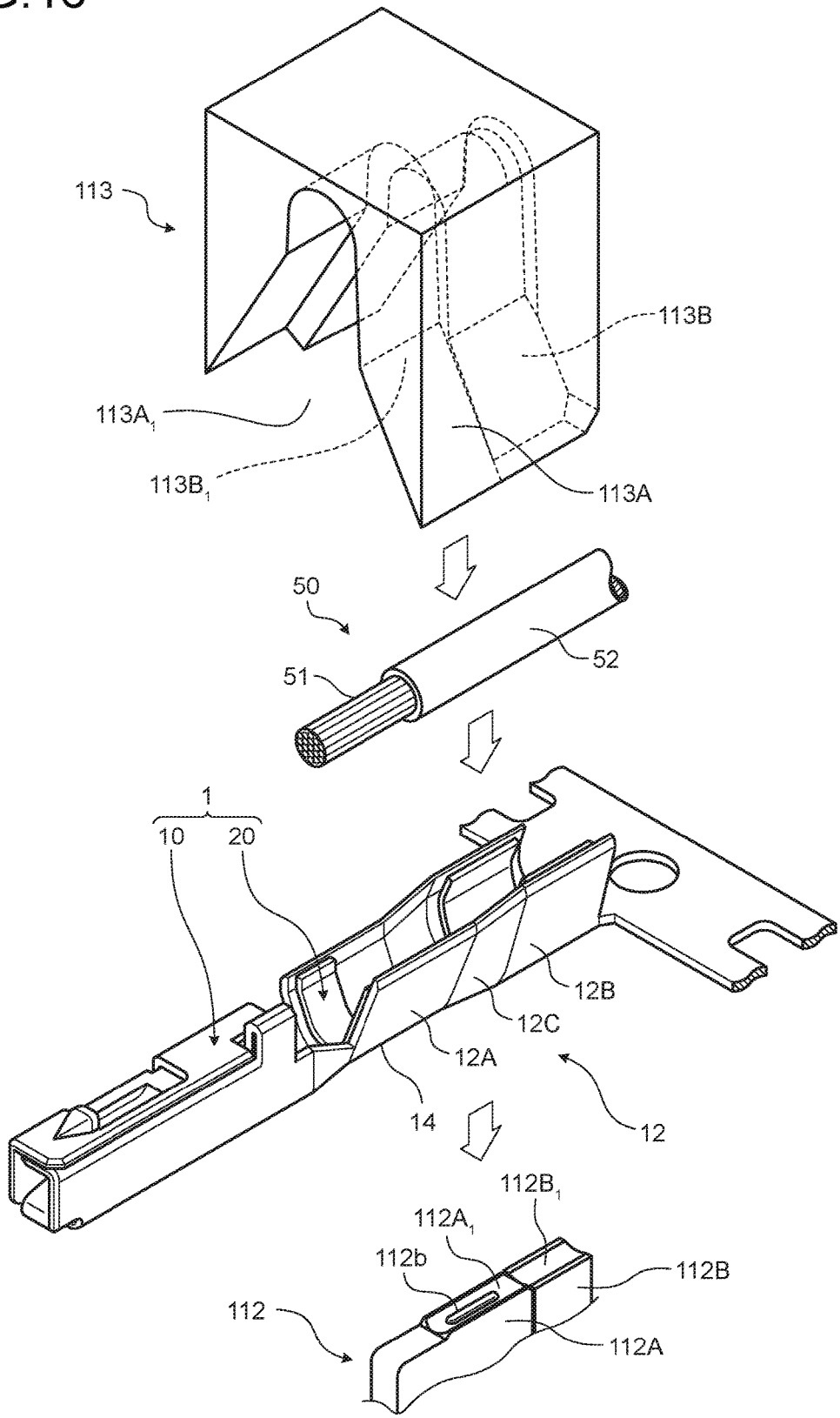
FIG. 16 is a perspective view for explaining a first die and a second die according to the embodiment.

The first die 112 and the second die 113 are arranged in the vertical direction with a gap interposed therebetween. The first die 112 and the second die 113 are crimping dies that sandwich the crimp terminal 1 and the end of the electric wire 50 placed therebetween to crimp the crimp terminal 1 to the end of the electric wire 50 (FIG. 16). The first die 112 includes two lower dies of a first anvil 112A and a second anvil 112B. The second die 113 includes two upper dies of a first crimper 113A and a second crimper 113B. The first anvil 112A and the first crimper 113A are arranged facing each other in the vertical direction. The first anvil 112A and the first crimper 113A reduces the gap therebetween, thereby crimping the U-shaped core wire crimping portion 12A to the core wire 51 at the distal end. The second anvil 112B and the second crimper 113B are arranged facing each other in the vertical direction. The second anvil 112B and the second crimper 113B reduces the gap therebetween, thereby crimping the U-shaped cover crimping portion 12B to the cover 52.

The driving device 103 transmits its power to the power transmission mechanism 114 to reduce the gap between the first anvil 112A and the first crimper 113A and the gap between the second anvil 112B and the second crimper 113B in crimping. After the crimping, the driving device 103 increases the gap between the first anvil 112A and the first crimper 113A and the gap between the second anvil 112B and the second crimper 113B. In this example, the driving device 103 moves the second die 113 up and down with respect to the first die 112, thereby moving the first crimper 113A and the second crimper 113B up and down simultaneously with respect to the first anvil 112A and the second anvil 112B. The first anvil 112A and the second anvil 112B and the first crimper 113A and the second crimper 113B may be separately formed bodies. In this case, the driving device 103 and the power transmission mechanism 114 may move the first crimper 113A and the second crimper 113B up and down separately. In this example, crimping of the core wire crimping portion 12A is started by the first anvil 112A and the first crimper 113A first, and crimping of the cover crimping portion 12B is then started by the second anvil 112B and the second crimper 113B.

The power transmission mechanism 114 according to the present embodiment transmits power output from the driving device 103 to the first crimper 113A and the second crimper 113B. As illustrated in FIG. 15, the power transmission mechanism 114 includes the ram 114A, a ram bolt 114B, and a shank 114C.

The ram 114A is a movable member supported in a manner capable of moving up and down with respect to the ram support portion 111$C_2$. The second die 113 is fixed to the ram 114A. With this configuration, the first crimper 113A and the second crimper 113B can move up and down with respect to the ram support portion 111$C_2$ together with the ram 114A. The ram 114A is formed into a rectangular parallelepiped shape, for example, and has a female screw (not illustrated). The female screw is formed on the inner peripheral surface of a hole extending in the vertical direction from the inner part of the ram 114A to the upper end surface.

The ram bolt 114B has a male screw (not illustrated) screwed into the female screw of the ram 114A. With this configuration, the ram bolt 114B can move up and down with respect to the ram support portion 111$C_2$ together with the ram 114A. The ram bolt 114B has a bolt head 114$B_1$ arranged above the male screw. The bolt head 114$B_1$ has a female screw (not illustrated). The female screw is formed on the inner peripheral surface of a hole extending in the vertical direction from the inner part of the bolt head 114$B_1$ to the upper end surface.

The shank 114C is a cylindrical hollow member and has a male screw 114$C_1$ and a connecting portion (not illustrated) at respective ends. The male screw 114$C_1$ of the shank 114C is provided on the lower side of the hollow member and screwed into the female screw in the bolt head 114$B_1$ of the ram bolt 114B. With this configuration, the shank 114C can move up and down with respect to the ram support portion 111$C_2$ together with the ram 114A and the ram bolt 114B. The connecting portion is connected to the driving device 103.

The driving device 103 includes a driving source (not illustrated) and a power conversion mechanism (not illustrated) that converts driving power of the driving source into power in the vertical direction. The connecting portion of the shank 114C is coupled to an output shaft of the power conversion mechanism. With this configuration, output from the driving device 103 (output from the power conversion mechanism) causes the first crimper 113A and the second crimper 113B to move up and down with respect to the ram support portion 111$C_2$ together with the ram 114A, the ram bolt 114B, and the shank 114C. Examples of the driving source include, but are not limited to, an electric actuator such as an electric motor, a hydraulic actuator such as a hydraulic cylinder, a pneumatic actuator such as an air cylinder, etc.

The relative position of the first crimper 113A with respect to the first anvil 112A in the vertical direction and the relative position of the second crimper 113B with respect to the second anvil 112B in the vertical direction can be changed by adjusting the amount of screwing of the male screw 114$C_1$ of the shank 114C into the female screw of the bolt head 114$B_1$. A nut 114D is screwed with the male screw 114$C_1$ of the shank 114C above the ram bolt 114B and has a function of what is called a lock nut together with the female screw of the bolt head 114$B_1$. By fastening the nut 114D to the ram bolt 114B after adjustment of the relative positions is completed, the first crimper 113A and the second crimper 113B can be fixed to the respective relative positions.

The first anvil 112A and the second anvil 112B have a recessed surface 112$A_1$ and a recessed surface 112$B_1$, respectively, recessed downward at their upper ends (FIG. 16). The recessed surfaces 112$A_1$ and 112$B_1$ are formed into an arc shape corresponding to the shape of the bottom 14 of the U-shaped core wire crimping portion 12A and the U-shaped cover crimping portion 12B, respectively. In the crimping machine 110, the recessed surfaces 112$A_1$ and 112$B_1$ correspond to the crimping position. The crimp terminal 1 transferred with the bottom 14 facing downward is placed such that the bottom 14 of the core wire crimping portion 12A is placed on the recessed surface 112$A_1$ formed at the upper end of the first anvil 112A and that the bottom 14 of the cover crimping portion 12B is placed on the recessed surface 112$B_1$ formed at the upper end of the second anvil 112B. The first die 112 is supported by the anvil support 111B with the recessed surfaces 112$A_1$ and 112$B_1$ exposed upward.

Figure 17:
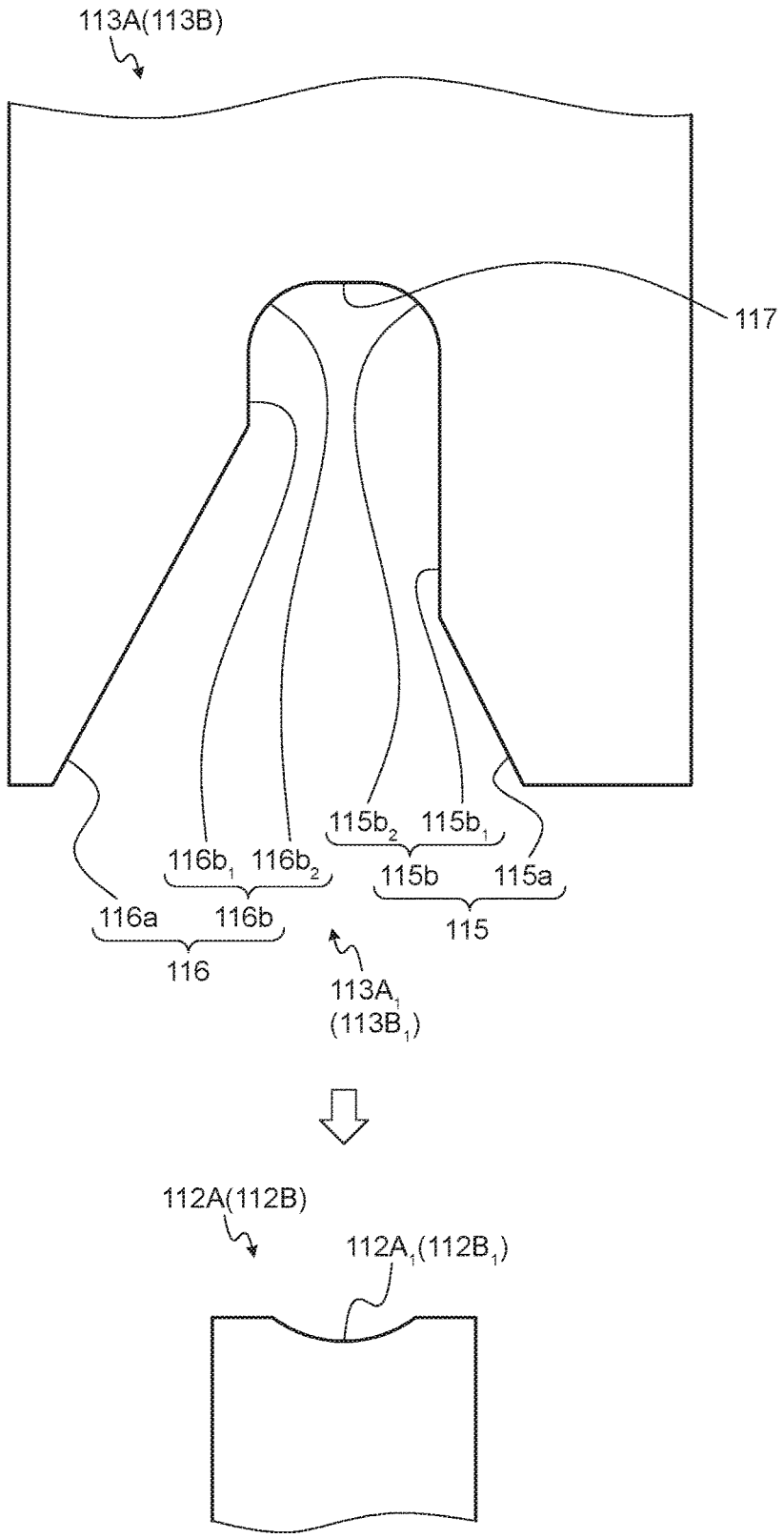
FIG. 17 is a front view for explaining the first die and the second die according to the embodiment.

The first crimper 113A and the second crimper 113B have a recessed portion 113$A_1$ and a recessed portion 113$B_1$, respectively, recessed upward (FIGS. 16 and 17). The recessed portions 113$A_1$ and 113$B_1$ are arranged facing the recessed surfaces 112$A_1$ and 112$B_1$ of the first anvil 112A and the second anvil 112B, respectively, in the vertical direction. The recessed portions 113$A_1$ and 113$B_1$ each have a first wall surface 115, a second wall surface 116, and a third wall surface 117. The first and the second wall surfaces 115 and 116 face each other. The third wall surface 117 connects the upper ends of the first and the second wall surfaces 115 and 116. The recessed portions 113$A_1$ and 113$B_1$ wind and caulk the first barrel piece 15 and the second barrel piece 16 around the end of the electric wire 50 with the first to the third wall surfaces 115 to 117 brought into contact with the first barrel piece 15 and the second barrel piece 16. The recessed portions 113$A_1$ and 113$B_1$ are formed so as to perform the caulking operation described above.

The first wall surface 115 that comes into contact with the first barrel piece 15 first has a receiving portion 115*a* and a thrusting portion 115*b*.

The receiving portion 115*a* is a wall surface brought into contact with the first barrel piece 15 first. When the second die 113 descends, the distal end 15*a* of the first barrel piece 15 comes into contact with the receiving portion 115*a*. The receiving portion 115*a* is inclined such that it gradually comes closer to the second wall surface 116 in a direction away from the recessed surfaces 112$A_1$ and 112$B_1$ of the first anvil 112A and the second anvil 112B (that is, in an upward direction). With this structure, when the second die 113 descends, the first barrel piece 15 slides on the receiving portion 115*a* and is pushed and moved toward the electric wire 50 sequentially from the distal end 15*a*.

The thrusting portion 115*b* is a wall surface that thrusts the first barrel piece 15 pushed and moved by the receiving portion 115*a* toward the end of the electric wire 50. The thrusting portion 115*b* has a vertical surface 115$b_1$ and an arc surface 115$b_2$. The vertical surface 115$b_1$ has a planar shape and extends upward from the boundary portion with the receiving portion 115*a*. The arc surface 115$b_2$ is connected to the vertical surface 115$b_1$ and thrusts the first barrel piece 15 sliding along the vertical surface 115$b_1$ toward the end of the electric wire 50 from the distal end 15*a*. The vertical surface 115$b_1$ is a plane extending along the moving direction of the second die 113. The arc surface 115$b_2$ is smoothly connected to the vertical surface 115$b_1$ and has an arc shape extending toward the second wall surface 116. Because the third wall surface 117 is provided in this example, the arc surface 115$b_2$ is formed so as to smoothly connect the vertical surface 115$b_1$ to the third wall surface 117. With the thrusting portion 115*b*, the first barrel piece 15 slides on the thrusting portion 115*b* when the second die 113 descends. When reaching the arc surface 115$b_2$, the first barrel piece 15 is thrusted toward the electric wire 50 sequentially from the distal end 15*a* side.

Similarly to the first wall surface 115, the second wall surface 116 that comes into contact with the second barrel piece 16 first has a receiving portion 116*a* and a thrusting portion 116*b*.

The receiving portion 116*a* is a wall surface brought into contact with the second barrel piece 16 first. When the second die 113 descends, the distal end 16*a* of the second barrel piece 16 comes into contact with the receiving portion 116*a*. The receiving portion 116*a* is inclined such that it gradually comes closer to the first wall surface 115 in a direction away from the recessed surfaces 112$A_1$ and 112$B_1$ of the first anvil 112A and the second anvil 112B (that is, in an upward direction). With this structure, when the second die 113 descends, the second barrel piece 16 slides on the receiving portion 116*a* and is pushed and moved toward the electric wire 50 sequentially from the distal end 16*a* side.

The thrusting portion 116*b* is a wall surface that thrusts the second barrel piece 16 pushed and moved by the receiving portion 116*a* toward the end of the electric wire 50. The thrusting portion 116*b* has a vertical surface 116$b_1$ and an arc surface 116$b_2$. The vertical surface 116$b_1$ has a planar shape and extends upward from the boundary portion with the receiving portion 116*a*. The arc surface 116$b_2$ is connected to the vertical surface 116$b_1$ and thrusts the second barrel piece 16 sliding along the vertical surface 116$b_1$ toward the end of the electric wire 50 from the distal end 16*a*. The vertical surface 116$b_1$ is a plane extending along the moving direction of the second die 113. The arc surface 116$b_2$ is smoothly connected to the vertical surface 116$b_1$ and has an arc shape extending toward the first wall surface 115. Because the third wall surface 117 is provided in this example, the arc surface 116$b_2$ is formed so as to smoothly connect the vertical surface 116$b_1$ to the third wall surface 117. With the thrusting portion 116*b*, the second barrel piece 16 slides on the thrusting portion 116*b* when the second die 113 descends. When reaching the arc surface 116$b_2$, the second barrel piece 16 is thrusted toward the electric wire 50 sequentially from the distal end 16*a* side.

The third wall surface 117 is a plane orthogonal to the moving direction (vertical direction) of the second die 113 or an arc plane smoothly connecting the arc surfaces 115$b_2$ and 116$b_2$ of the thrusting portions 115*b* and 116*b*, respectively.

The second barrel piece 16 is longer than the first barrel piece 15. When the second die 113 descends, the distal end 16*a* of the second barrel piece 16 slides on the second wall surface 116 and reaches the third wall surface 117. Subsequently, the distal end 16*a* of the second barrel piece 16 slides on the third wall surface 117 and reaches the first wall surface 115. While moving across the slide contact surfaces of the second die 113, the second barrel piece 16 is thrusted toward the electric wire 50 and wound around the first barrel piece 15 and the electric wire 50. At this time, the inner wall surface of the second barrel piece 16 pushes and moves the first barrel piece 15 toward the electric wire 50, thereby assisting the first barrel piece 15 to be thrusted toward the electric wire 50. After being thrusted toward the electric wire 50 by the arc surface 115$b_2$, the first barrel piece 15 keeps being thrusted by the force from the second barrel piece 16 and is wound around the electric wire 50.

The crimp terminal 1 crimped by the crimping machine 110 in this manner is cut off from the connection piece 31 by the terminal cutting machine 120. The terminal cutting machine 120 sandwiches and cuts the coupling portion 32 of the crimp terminal 1 transferred to the crimping position using two terminal cutting parts. The terminal cutting machine 120 performs the cutting along with the progress of the crimping process. The terminal cutting machine 120 is arranged on the front side of the second anvil 112B (on the left side in the drawing in FIG. 15).

The terminal cutting machine 120 is publicly known in this technical field and includes a terminal cutter 121, a pressing member 122, and an elastic member 123. The terminal cutter 121 is arranged along the front surface of the second anvil 112B in a manner capable of sliding in the vertical direction. In the terminal cutting machine 120, the terminal cutter 121 and the second anvil 112B each have a terminal cutting part. The pressing member 122 is fixed to the ram 114A and moves up and down together with the ram 114A. The pressing member 122 is arranged above the terminal cutter 121 and descends to press the terminal cutter 121. The elastic member 123 applies upward bias force to the terminal cutter 121 and is a spring member, for example. When the pressing force from the pressing member 122 is canceled, the elastic member 123 returns the terminal cutter 121 to the initial position in the vertical direction. In the terminal cutting machine 120, the pressing member 122 descends along with a descent of the second die 113 in crimping, thereby pressing the terminal cutter 121. As a result, the terminal cutting parts cut the coupling portion 32, thereby cutting off the crimp terminal 1 from the terminal chain body 30.

The electric wire 50 serving as an object of crimping is arranged at a predetermined position between the terminal cutter 121 and the pressing member 122. The predetermined position is as follows: the end of the electric wire 50 yet to be subjected to crimping is positioned above the bottom 14 of the planar electric wire connecting portion 12, and the core wire 51 is placed on the bottom 14 of the core wire crimping portion 12A such that the distal end position of the core wire 51 at the distal end pressed along with the start of crimping does not protrude from the core wire crimping portion 12A. The distal end of the core wire 51 at the distal end may possibly extend in the axial direction along with crimping from the position at which the distal end is placed. The predetermined position is preferably determined taking the expansion into consideration. In the crimp terminal 1, the distal end of the core wire 51 at the distal end being subjected to crimping is set to the position described above, thereby preventing the core wire 51 from protruding from the second water stop area 22. Consequently, the crimp terminal 1 can secure the water stop performance of the second water stop area 22.

When the first barrel piece 15 and the second barrel piece 16 are brought into contact with each other for the first time in crimping, the end surfaces of the distal ends 15*a* and 16*a* preferably do not abut on each other. Contact of the end surfaces may possibly cause unnecessary deformation of the first barrel piece 15 and the second barrel piece 16 or cause the second barrel piece 16 to enter between the first barrel piece 15 and the electric wire 50. As a result, desired crimping may possibly fail to be performed.

Figure 18:
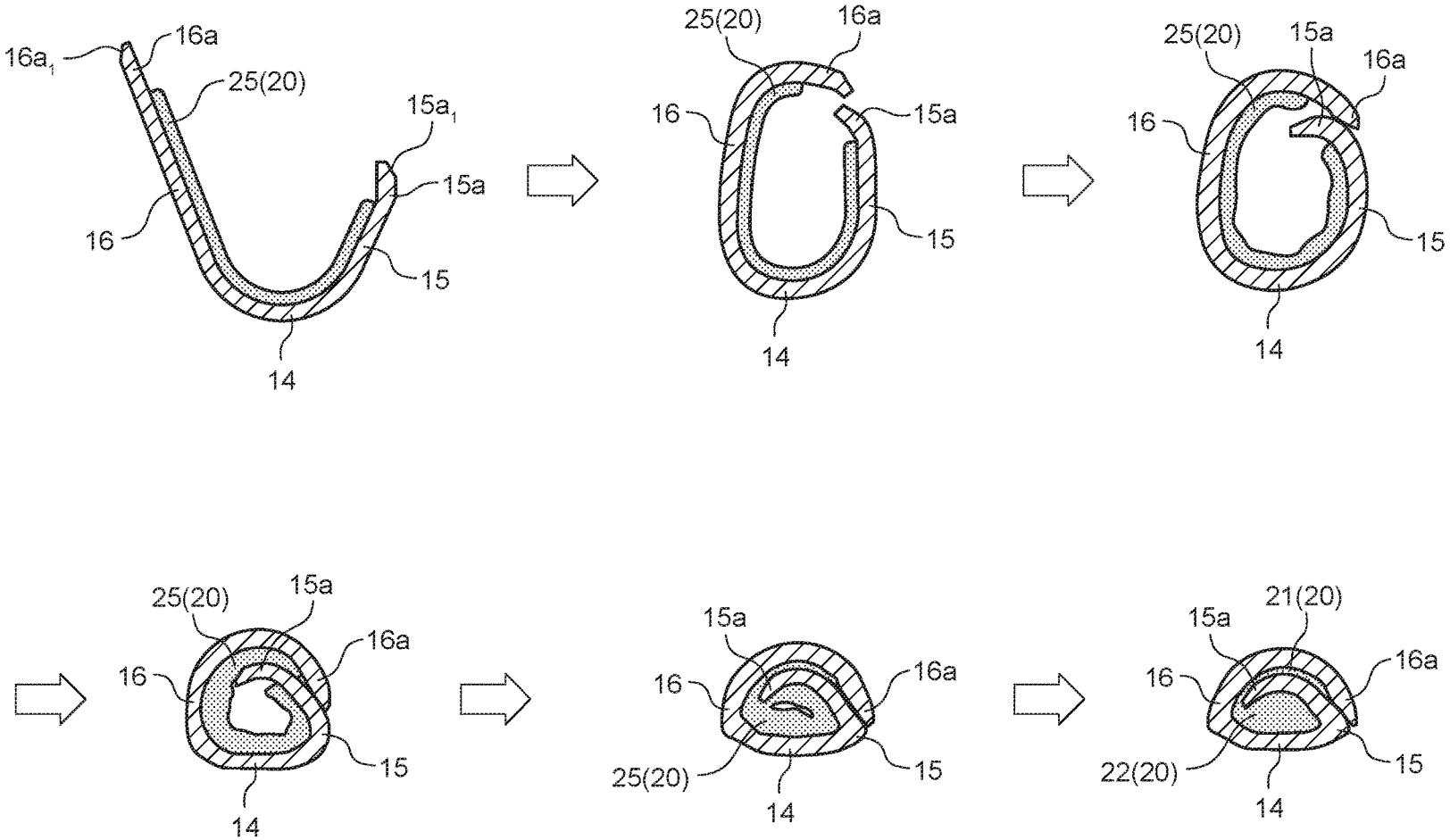
FIG. 18 is a diagram of a crimping process performed at a part along line Y1-Y1 in FIG. 4.
Figure 19:
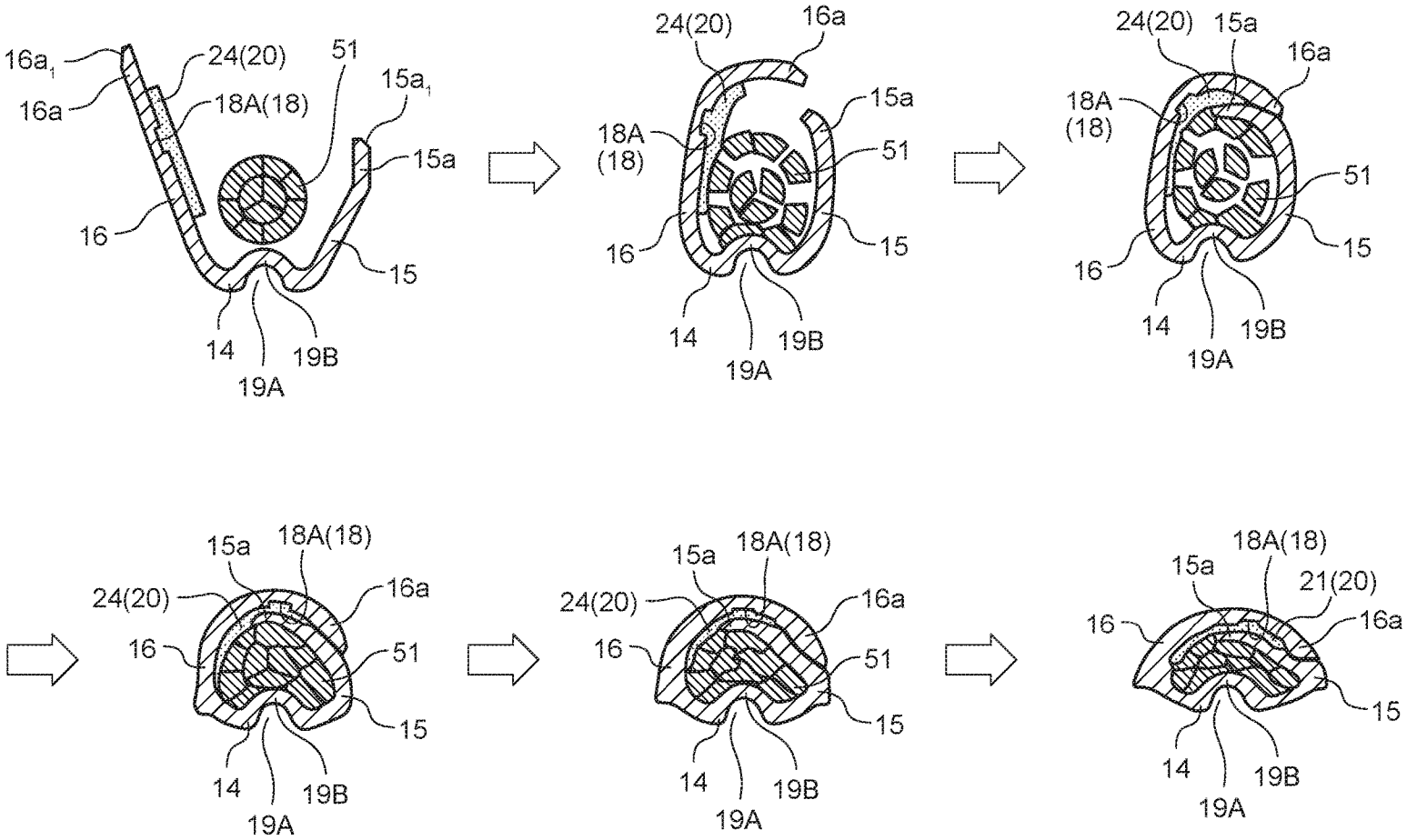
FIG. 19 is a diagram of a crimping process performed at a part along line Y2-Y2 in FIG. 4.
Figure 20:
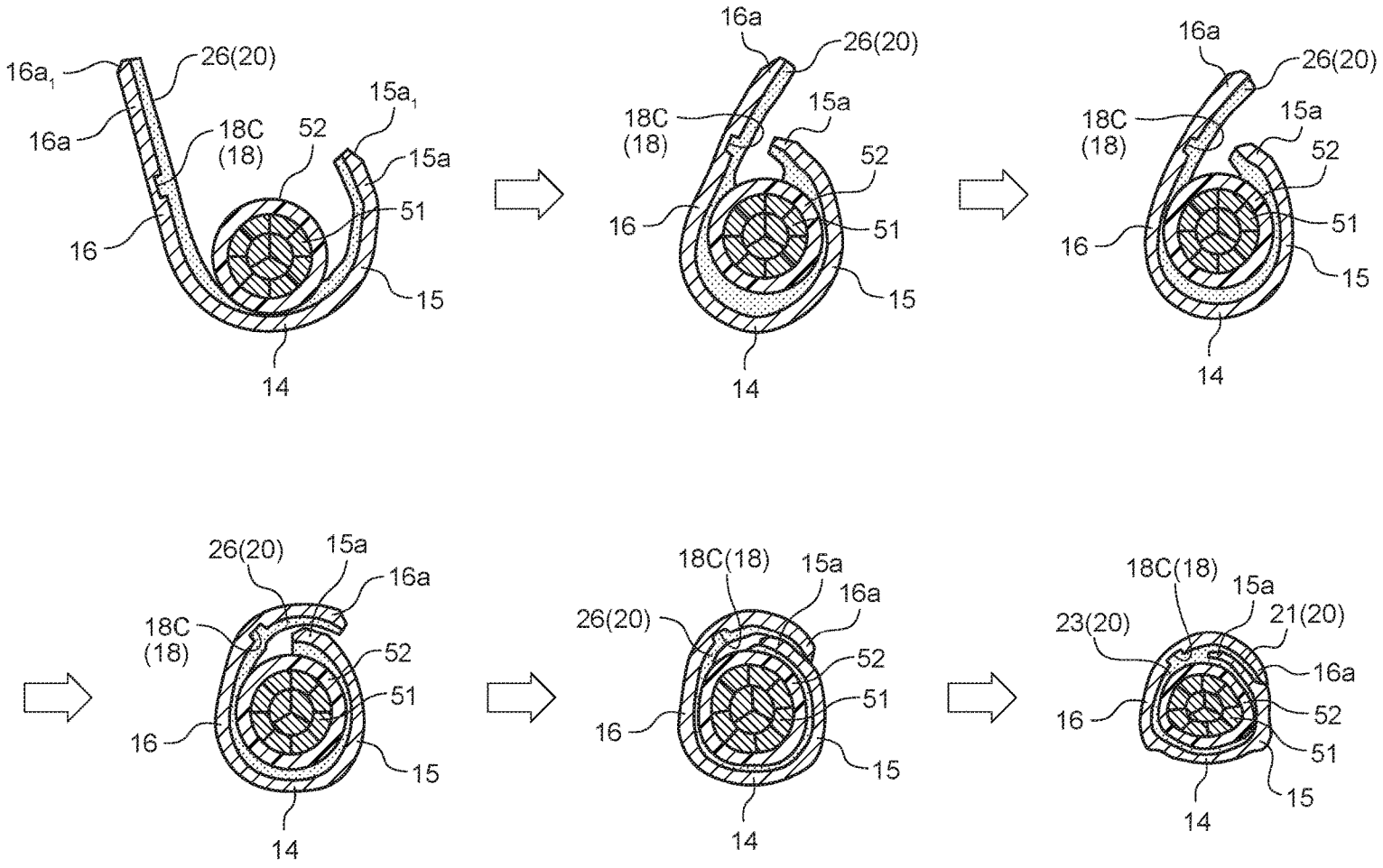
FIG. 20 is a diagram of a crimping process performed at a part along line Y3-Y3 in FIG. 4.

In the crimp terminal 1 according to the present embodiment, the distal end 15*a* of the first barrel piece 15 in the U-shaped electric wire connecting portion 12 is bent toward the second barrel piece 16 (FIG. 7). The bend forms a gap between the distal end 15*a* and the slide contact surface for the first barrel piece 15 (specifically, the vertical surface 115$b_1$ in the thrusting portion 115*b* of the first wall surface 115) of the descending second die 113 (the first crimper 113A and the second crimper 113B). In the crimp terminal 1 according to the present embodiment, the distal end 15*a* of the first barrel piece 15 is formed into the shape described above. With this structure, the crimp terminal 1 reduces the possibility that the end surfaces of the distal ends 15*a* and 16*a* come into contact with each other in crimping and enables the second barrel piece 16 to enter between the first barrel piece 15 and the first wall surface 115 (FIGS. 18 to 20). FIG. 18 is a diagram of a crimping process performed at a part along line Y1-Y1 in FIG. 4 (part closer to the terminal connecting portion 11 than the distal end position of the core wire 51 at the distal end). FIG. 19 is a diagram of a crimping process performed at a part along line Y2-Y2 in FIG. 4 (part crimped to the core wire 51 at the distal end).

Figure 4:
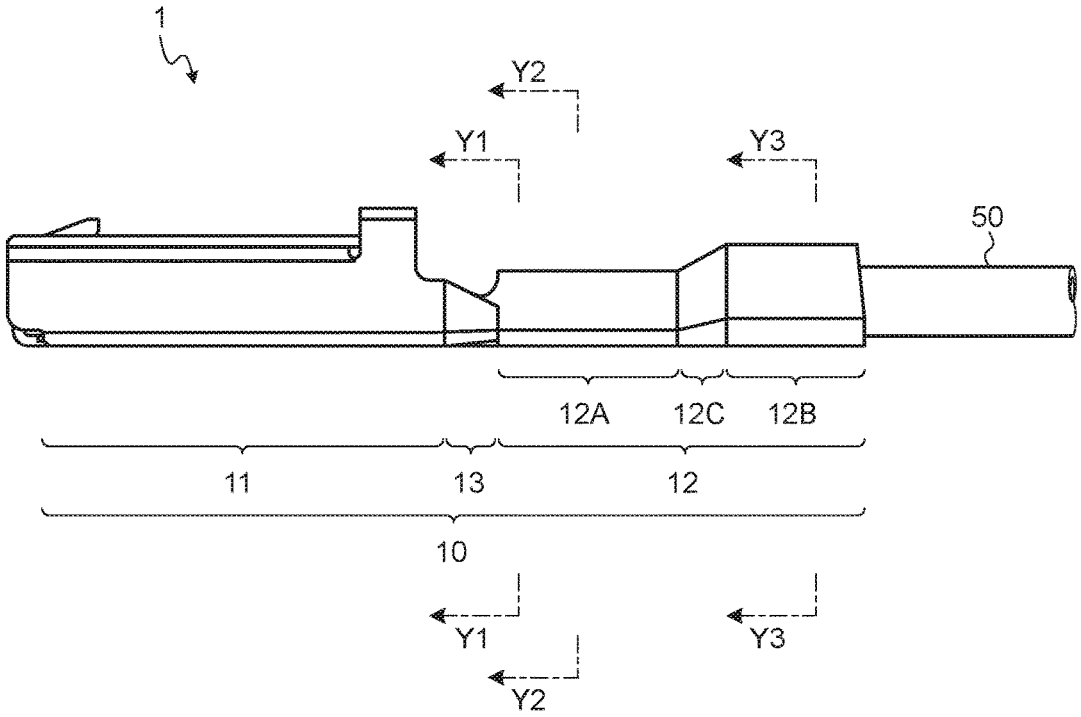
FIG. 4 is a side view of the crimp terminal after completion of crimping according to the embodiment.

FIG. 20 is a diagram of a crimping process performed at a part along line Y3-Y3 in FIG. 4 (part crimped to the cover 52). FIGS. 18 to 20 do not illustrate the first die 112 or the second die 113 to simplify the illustration.

With the distal end 15*a* of the first barrel piece 15 having the shape described above, the crimp terminal 1 can suppress unnecessary deformation of the first barrel piece 15 and the second barrel piece 16, displacement of the electric wire connecting portion 12, and other faults caused by contact of the end surfaces of the distal ends 15*a* and 16*a*. The crimp terminal 1 thus enables desired crimping and can improve the water stop performance of the water stop member 20. In the crimp terminal 1, the affixing area of the water stop member 20 on the inner wall surface of the second barrel piece 16 is preferably determined such that the water stop member 20 on the inner wall surface of the second barrel piece 16 can cover the outer wall surface of the distal end 15*a* of the first barrel piece 15 after completion of crimping. With this structure, the crimp terminal 1 has the first water stop area 21 between the outer wall surface of the distal end 15*a* and the inner wall surface of the second barrel piece 16, thereby improving the water stop performance therebetween. On the side closer to the terminal connecting portion 11 than the distal end position of the core wire 51 at the distal end, the distal end 15*a* is covered with the water stop member 20 both on the inner wall surface side and on the outer wall surface side. This structure can improve the water stop performance in the second water stop area 22.

Specifically, the distal end 15*a* of the first barrel piece 15 is bent such that the gap between the slide contact surface and the distal end 15*a* is larger than at least the thickness of the distal end 16*a* of the second barrel piece 16. In a case where the water stop member 20 is affixed to the distal end 16*a* of the second barrel piece 16, the distal end 15*a* of the first barrel piece 15 is bent such that the gap between the slide contact surface and the distal end 15*a* is larger than at least the sum of the thickness of the distal end 16*a* of the second barrel piece 16 and the thickness of the water stop member 20. The distal end 15*a* of the first barrel piece 15 according to the present embodiment, for example, is bent toward the second barrel piece 16 such that the gap between the distal end 15*a* and the vertical surface 115$b_1$ is larger than at least the thickness of the distal end 16*a* of the second barrel piece 16 (the sum of the thickness of the distal end 16*a* and the thickness of the water stop member 20 in a case where the water stop member 20 is affixed to the distal end 16*a*) when the distal end 15*a* reaches the vertical surface 115$b_1$ along with a descent of the second die 113. In other words, the distal end 15*a* of the first barrel piece 15 is bent toward the second barrel piece 16 such that the gap between a virtual plane including the outer wall surface of its main part and the end surface of the distal end 15*a* is larger than at least the thickness of the distal end 16*a* of the second barrel piece 16 (the sum of the thickness of the distal end 16*a* and the thickness of the water stop member 20 in a case where the water stop member 20 is affixed to the distal end 16*a*). This structure can suppress contact of the end surfaces of the distal ends 15*a* and 16*a* in the crimping process and enable the second barrel piece 16 to enter between the first barrel piece 15 and the first wall surface 115.

The shape of the bent distal end 15*a* (mainly, the angle of the bend of the distal end 15*a* and the start position of the bend (that is, the length of the bent part)) is preferably determined such that the end of the electric wire 50 can be inserted between the first barrel piece 15 and the second barrel piece 16 in crimping and that the distal end 15*a* does not come into contact with the end of the electric wire 50 during the insertion. With this structure, the crimp terminal 1 according to the present embodiment can prevent the bent distal end 15*a* from hindering the crimping. The bent shape of the distal end 15*a* may be different in the core wire crimping portion 12A and the cover crimping portion 12B. The distal end 15*a* of the cover crimping portion 12B, for example, preferably has a bent shape such that the end surface of the distal end 15*a* does not come into contact with the cover 52. With this structure, the crimp terminal 1 can suppress a break or other faults in the cover 52 caused by the distal end 15*a*.

The distal ends 15*a* and 16*a* preferably have tapered surfaces 15$a_1$ and 16$a_1$, respectively, on the outer wall surface side (FIGS. 18 to 20). In the tapered surfaces 15$a_1$ and 16$a_1$, the thicknesses of the distal ends 15*a* and 16*a* decrease as they extend from the bottom 14 to the respective end surfaces. The tapered surfaces 15$a_1$ and 16$a_1$ may be formed in the pressing process for the electric wire connecting portion 12. In the crimp terminal 1 according to the present embodiment, the tapered distal ends 15*a* and 16*a* can increase the gap between the distal end 15*a* and the first wall surface 115 and reduce the thickness of the end surface side of the distal end 16*a* inserted therebetween. This structure suppresses contact of the end surfaces of the distal ends 15*a* and 16*a* in the crimping process and facilitates insertion of the second barrel piece 16 between the first barrel piece 15 and the first wall surface 115. Consequently, the crimp terminal 1 enables desired crimping and can improve the water stop performance of the water stop member 20.

Even if the bending of the distal end 15*a* and other processing are carried out, the end surface of the distal end 16*a* may possibly come into contact with the end surface of the distal end 15*a*, or the second barrel piece 16 may possibly enter between the first barrel piece 15 and the electric wire 50 if the electric wire connecting portion 12 being crimped is not kept in the correct attitude with respect to the first and the second dies 112 and 113. The correct attitude indicates a state where the electric wire connecting portion 12 is placed on the recessed surfaces 112$A_1$ and 112$B_1$ with the bottom 14 at the lowest end and with the opening between the first barrel piece 15 and the second barrel piece 16 facing the first and the second crimpers 113A and 113B. In the crimp terminal 1, for example, the arc-shaped bottom 14 of the electric wire connecting portion 12 is placed on the arc-shaped recessed surfaces 112$A_1$ and 112$B_1$, and the length of the first barrel piece 15 is different from that of the second barrel piece 16. With this structure, the electric wire connecting portion 12 may possibly rotate in the circumferential direction of the recessed surfaces 112$A_1$ and 112$B_1$ depending on application of force from the first crimper 113A to the first barrel piece 15 and application of force from the second crimper 113B to the second barrel piece 16. The present embodiment preferably suppresses rotation of the electric wire connecting portion 12 being crimped by employing at least one of the methods described below.

To suppress rotation of the electric wire connecting portion 12, for example, at least one of the terminal connecting portion 11, the connection piece 31, and the coupling portion 32 arranged at both ends of the electric wire connecting portion 12 is held during crimping.

Figure 21:
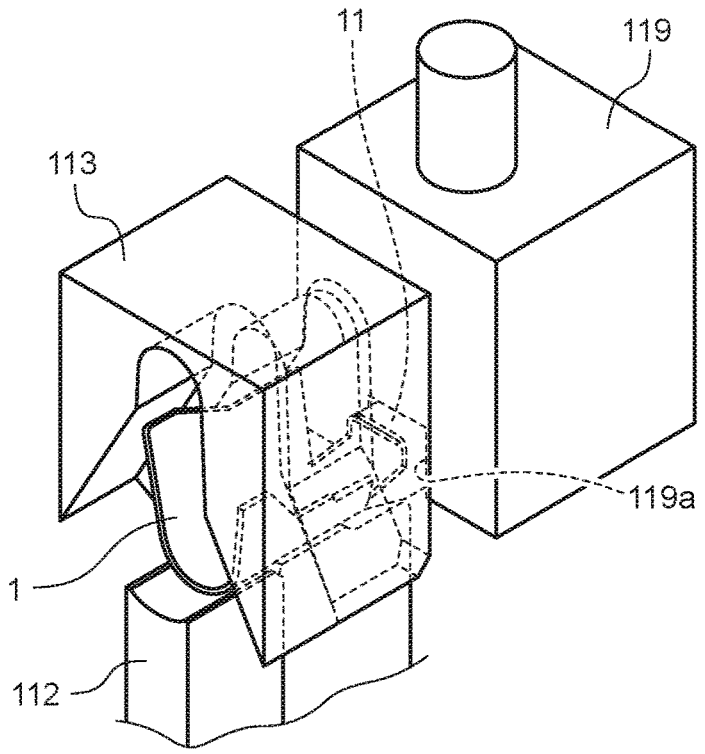
FIG. 21 is a view for explaining a state of holding a terminal connecting portion by a rotation suppressor.

To hold the terminal connecting portion 11, the terminal crimping device 100 may include a rotation suppressor 119 that suppresses rotation of the terminal connecting portion 11 of the crimp terminal 1 placed at the crimping position (FIG. 21). The rotation suppressor 119 in this example holds the terminal connecting portion 11 from both side surfaces in the second direction W. The rotation suppressor 119 has a rectangular parallelepiped space (holding portion) 119*a* into which the terminal connecting portion 11 is inserted. The rotation suppressor 119 is fixed to the ram 114A, for example, and is moved up and down together with the second die 113. The rotation suppressor 119 descends together with the second die 113, thereby receiving the terminal connecting portion 11 into the holding portion 119*a*. The timing at which the terminal connecting portion 11 is inserted into the holding portion 119*a* is set to earlier than the timing at which the first crimper 113A and the second crimper 113B come into contact with the first barrel piece 15 and the second barrel piece 16. With this configuration, the terminal crimping device 100 according to the present embodiment can suppress rotation of the terminal connecting portion 11 before the crimping is actually started and keep the electric wire connecting portion 12 being crimped in the correct attitude. The terminal crimping device 100 thus can suppress contact of the end surfaces of the distal ends 15*a* and 16*a* in the crimping process and enable the second barrel piece 16 to enter between the first barrel piece 15 and the first wall surface 115. Consequently, the terminal crimping device 100 can suppress unnecessary deformation of the first barrel piece 15 and the second barrel piece 16 and other faults and perform desired crimping process.

Figure 22:
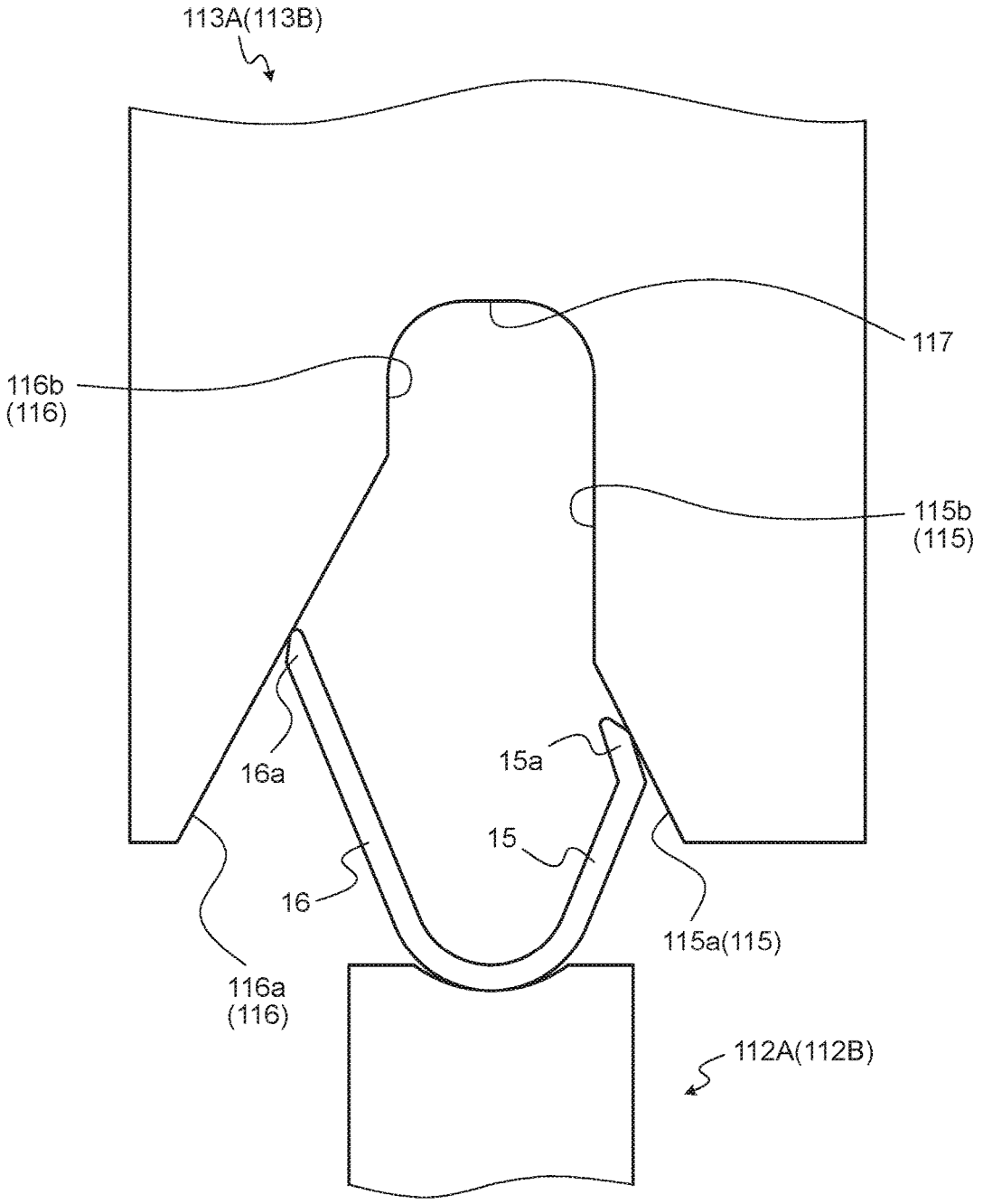
FIG. 22 is a view for explaining a rotation suppressing structure for the electric wire connecting portion by the second die (crimper)

Even if the terminal connecting portion 11 or the connection piece 31 is held, the electric wire connecting portion 12 may possibly rotate while the terminal connecting portion 11 or the like is being held if there is a gap between the timing at which force is applied from the second die 113 to the first barrel piece 15 (that is, the timing at which the second die 113 comes into contact with the first barrel piece 15) and the timing at which force is applied from the second die 113 to the second barrel piece 16 (that is, the timing at which the second die 113 comes into contact with the second barrel piece 16). To address this, the second die 113 descends such that the first wall surface 115 and the second wall surface 116 substantially simultaneously come into contact with the first barrel piece 15 and the second barrel piece 16, respectively (FIG. 22). In a case where crimping is performed from the core wire crimping portion 12A to the cover crimping portion 12B in order, the first crimper 113A comes into contact with the electric wire connecting portion 12 earlier than the second crimper 113B does. In this case, the first wall surface 115 and the second wall surface 116 of the first crimper 113A is formed such that they substantially simultaneously come into contact with the first barrel piece 15 and the second barrel piece 16, respectively. In a case where crimping is performed from the cover crimping portion 12B to the core wire crimping portion 12A in order, the second crimper 113B comes into contact with the electric wire connecting portion 12 earlier than the first crimper 113A does. In this case, the first wall surface 115 and the second wall surface 116 of the second crimper 113B is formed such that they substantially simultaneously come into contact with the first barrel piece 15 and the second barrel piece 16, respectively. In a case where crimping is performed from the coupling crimping portion 12C to the core wire crimping portion 12A and the cover crimping portion 12B, one of the first crimper 113A and the second crimper 113B comes into contact with the first barrel piece 15 and the second barrel piece 16 of the coupling crimping portion 12C first. In this case, the first wall surface 115 and the second wall surface 116 of the crimper coming into contact with the first barrel piece 15 and the second barrel piece 16 first is formed such that they substantially simultaneously come into contact with the first barrel piece 15 and the second barrel piece 16, respectively.

In the first wall surface 115 and the second wall surface 116 of the target crimper out of the first crimper 113A and the second crimper 113B, the receiving portions 115*a* and 116*a* are formed into shapes such that they can substantially simultaneously come into contact with the first barrel piece 15 and the second barrel piece 16, respectively. If the absolute values of the inclination angles of the receiving portions 115*a* and 116*a* are equal, for example, the first wall surface 115 and the second wall surface 116 are formed such that the boundary between the receiving portion 116*a* and the thrusting portion 116*b* is positioned above the boundary between the receiving portion 115*a* and the thrusting portion 115*b*. With this structure, the receiving portions 115*a* and 116*a* descends to substantially simultaneously come into contact with the first barrel piece 15 and the second barrel piece 16, respectively. The receiving portions 115*a* and 116*a* thus can substantially simultaneously apply substantially uniform force to the first barrel piece 15 and the second barrel piece 16. This structure can suppress rotation of the electric wire connecting portion 12 until the crimping is finished even if the second die 113 descends without any change. Consequently, the terminal crimping device 100 according to the present embodiment keeps the electric wire connecting portion 12 being crimped in the correct attitude. The terminal crimping device 100 thus can suppress contact of the end surfaces of the distal ends 15*a* and 16*a* in the crimping process and enable the second barrel piece 16 to enter between the first barrel piece 15 and the first wall surface 115. Consequently, the terminal crimping device 100 can perform desired crimping more appropriately.

The terminal crimping device 100 according to the present embodiment may suppress rotation of the electric wire connecting portion 12 being crimped by the first die 112. The bottom 14 of the electric wire connecting portion 12 in this example has a recess 19A formed in the pressing process (FIGS. 7, 11, and other figures). The recess 19A is recessed from the outer wall surface toward the inner wall surface. The end of the first die 112 has a protrusion 112*b* protruding toward the recess 19A at a position facing the recess 19A (FIG. 16). The protrusion 112*b* is formed on one or both of the recessed surface $112A_1$ of the first anvil 112A and the recessed surface $112B_1$ of the second anvil 112B. The recess 19A and the protrusion 112*b* are formed into shapes such that the protrusion 112*b* can be fitted into the recess 19A, for example. With this structure, the crimp terminal 1 transferred to the crimping position is prevented from moving relatively with respective to the first die 112 by the protrusion 112*b* fitting into the recess 19A. The terminal crimping device 100 thus can keep the electric wire connecting portion 12 being crimped in the correct attitude. The recess 19A and the protrusion 112*b* also have a function to position the transferred crimp terminal 1 at the crimp position. The crimp terminal 1 and the terminal crimping device 100 according to the present embodiment thus can suppress contact of the end surfaces of the distal ends 15*a* and 16*a* in the crimping process and enable the second barrel piece 16 to enter between the first barrel piece 15 and the first wall surface 115. Consequently, the crimp terminal 1 and the terminal crimping device 100 can perform desired crimping process.

The inner wall surface side of the electric wire connecting portion 12 has a protrusion 19B formed in the pressing of the recess 19A. In a case where the recess 19A and the protrusion 19B are formed on the bottom 14 of the core wire crimping portion 12A, the protrusion 19B is maintained until the crimping is finished. With this structure, the contact area of the core wire 51 at the distal end to the electric wire connecting portion 12 increases. As a result, the adhesion strength between the core wire 51 at the distal end and the electric wire connecting portion 12 increases, thereby improving the electrical connection therebetween. The recess 19A and the protrusion 19B according to the present embodiment are formed on the bottom 14 of at least the core wire crimping portion 12A. The protrusion 112*b* inserted into the recess 19A in crimping is formed on the recessed surface 112$A_1$ of the first anvil 112A. In this example, the recess 19A and the protrusion 19B are also formed on the coupling crimping portion 12C. The recess 19A, the protrusion 19B, and the protrusion 112*b* extend in the longitudinal direction (first direction L) of the core wire 51 at the distal end. The recess 19A, the protrusion 19B, and the protrusion 112*b* are formed into shapes such that the protrusion 19B protrudes from the inner wall surface of the bottom 14 even if the core wire 51 at the distal end compresses the protrusion 19B in crimping. With this structure, the crimp terminal 1 and the terminal crimping device 100 according to the present embodiment can increase the contact area of the core wire 51 at the distal end to the electric wire connecting portion 12 with the remaining protrusion 19B. As a result, the adhesion strength between the core wire 51 at the distal end and the electric wire connecting portion 12 increases, thereby improving the electrical connection therebetween. The crimp terminal 1 and the terminal crimping device 100 according to the present embodiment inserts the protrusion 112*b* into the recess 19A during the crimping process, thereby enabling the protrusion 19B to remain while performing the crimping process. Consequently, the crimp terminal 1 and the terminal crimping device 100 have high productivity and can secure the adhesion strength between the electric wire connecting portion 12 and the core wire 51. The recess 19A and the protrusion 19B in this example are formed in the serration area 17. With this structure, the remaining protrusion 19B and the serration area 17 increase the adhesion strength between the core wire 51 at the distal end and the electric wire connecting portion 12. As a result, the core wire 51 at the distal end is electrically connected to the electric wire connecting portion 12 more stably.

The size of the protrusion 112*b* may be larger than the size of the internal space of the recess 19A so that the protrusion 112*b* can be thrusted into the recess 19A in crimping, thereby pushing out the protrusion 19B toward the core wire 51. In other words, the size of the internal space of the recess 19A may be smaller than the size of the protrusion 112*b* so that the protrusion 112*b* can be thrusted into the recess 19A in crimping, thereby pushing out the protrusion 19B toward the core wire 51. The height of the protrusion 112*b* from the recessed surface 112$A_1$, for example, is set higher than the depth of the recess 19A from the outer wall surface of the electric wire connecting portion 12. By setting the protrusion 112*b* larger than the recess 19A in the crimp terminal 1, the protrusion 112*b* of the first anvil 112A is thrusted into the recess 19A to expand the protrusion 19B toward the electric wire 50 along with the progress of crimping. The expansion causes adhesive wear between the protrusion 19B and the core wire 51 at the distal end. With this structure, the crimp terminal 1 and the terminal crimping device 100 can further increase the contact area of the core wire 51 at the distal end to the electric wire connecting portion 12 with the recess 19A, the protrusion 19B, and the protrusion 112*b*. As a result, the adhesion strength between the core wire 51 at the distal end and the electric wire connecting portion 12 further increases, thereby further improving the electrical connection therebetween.

With the recess 19A, the protrusion 19B, and the protrusion 112*b*, the crimp terminal 1 and the terminal crimping device 100 according to the present embodiment can position the crimp terminal 1 and keep the attitude thereof. Furthermore, the crimp terminal 1 and the terminal crimping device 100 can improve the electrical connection between the core wire 51 at the distal end and the electric wire connecting portion 12 after the crimping. In a case where the crimp terminal 1 and the terminal crimping device 100 is provided with the core wire 51 made of aluminum, adhesive wear caused by the protrusion 19B can remove an oxide layer on the surface of the core wire 51. This structure can further improve the electrical connection between the core wire 51 at the distal end and the electric wire connecting portion 12. The recess 19A and the protrusion 19B may be one recess and one protrusion as described in the present embodiment or may be a plurality of recesses and protrusions. The number and the position of the protrusion 112*b* corresponds to those of the recess 19A.

After the distal end 16*a* of the second barrel piece 16 enters between the first barrel piece 15 and the first wall surface 115, the first barrel piece 15 and the second barrel piece 16 are caulked with the outer wall surface of the first barrel piece 15 and the inner wall surface of the second barrel piece 16 sliding on each other. At this time, the water stop member 20 on the second barrel piece 16 may possibly be scraped off by the first barrel piece 15 in a predetermined range from the distal end 16*a* to the bottom 14. The predetermined range is a sliding range 27*a* between the first barrel piece 15 and the water stop member 20 (FIGS. 23 and 24) and corresponds to the overlapping area. If the water stop member 20 is scraped off, the first to the third water stop areas 21 to 23 connected to one another may possibly fail to be appropriately formed, thereby deteriorating the water stop performance. The hatching in FIGS. 23 and 24 indicates, for convenience, the sliding range 27*a* in which the first barrel piece 15 slides on the water stop member 20 and a remaining range 27*b* in which the first barrel piece 15 does not slide on the water stop member 20.

Figure 23:
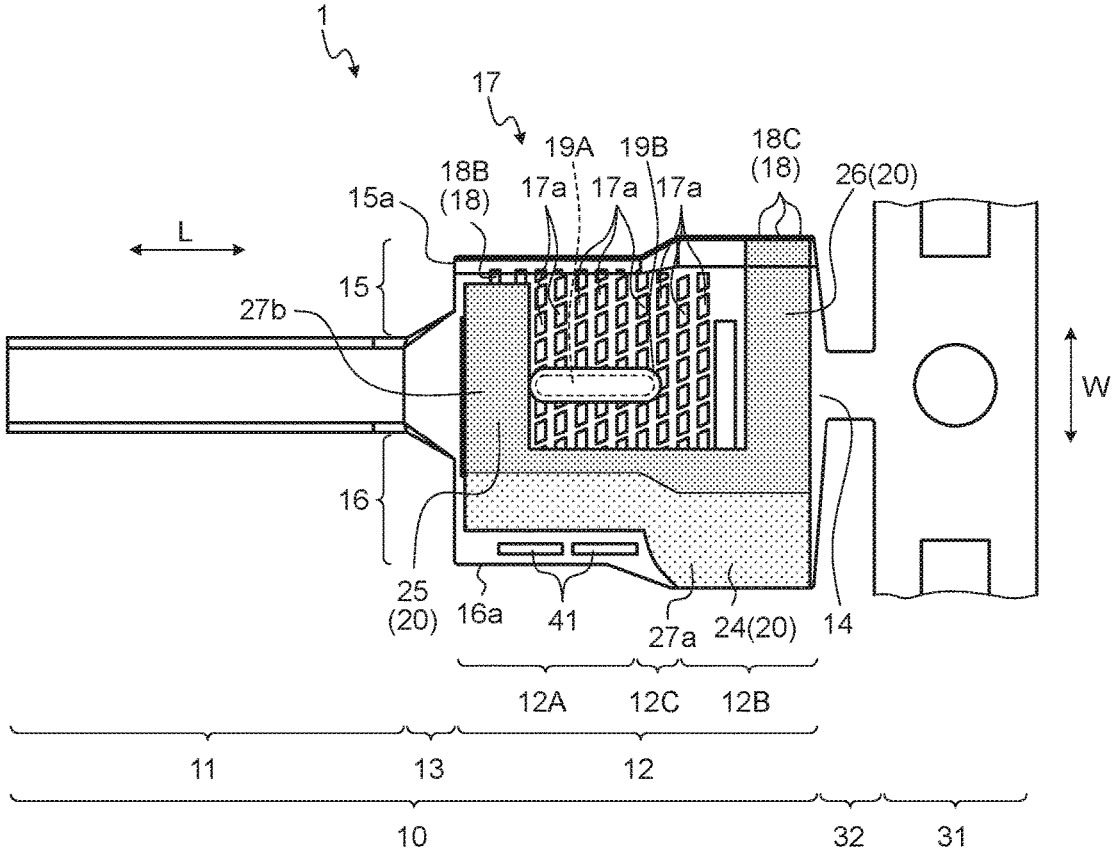
FIG. 23 is a view for explaining a sliding range and a remaining range in the water stop member.
Figure 24:
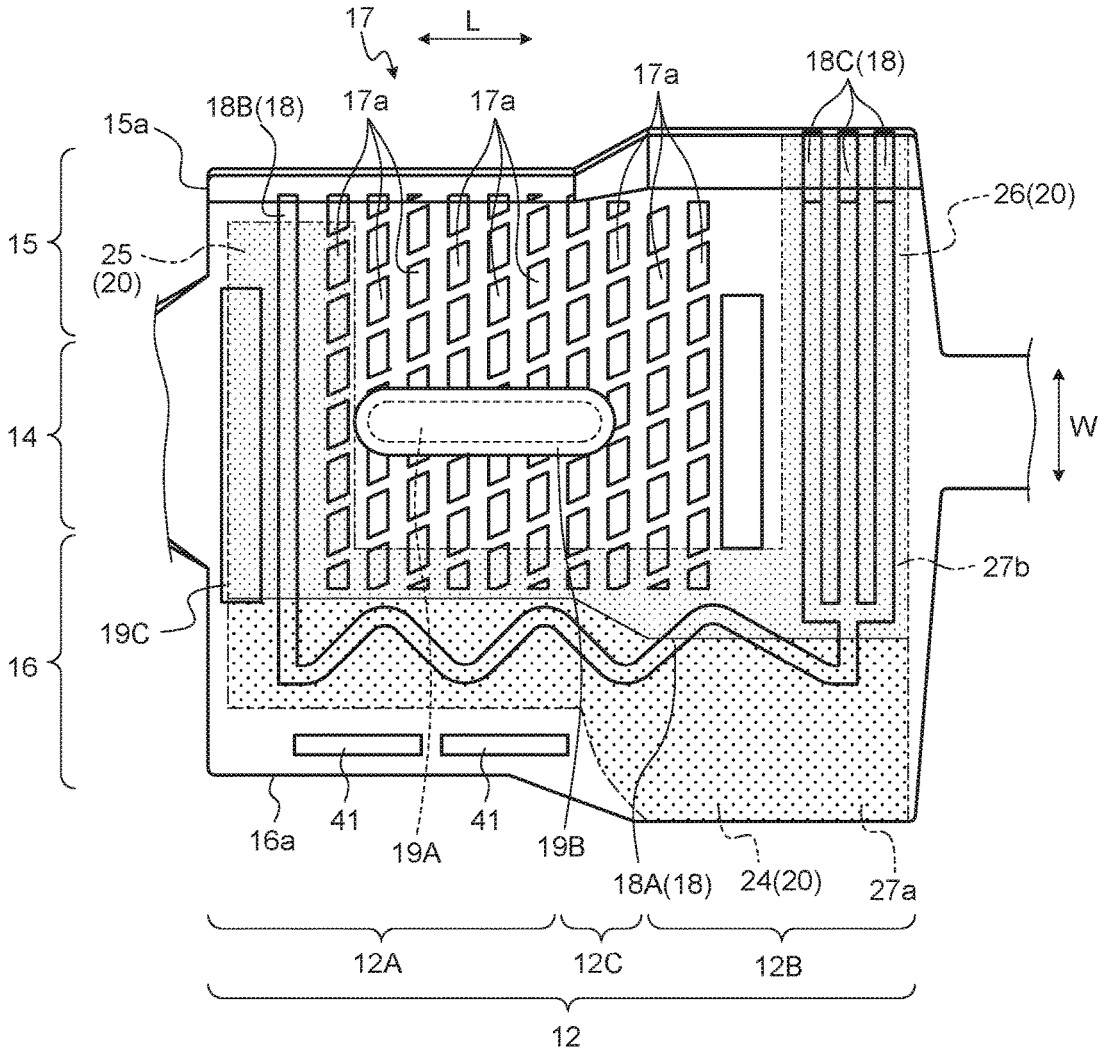
FIG. 24 is a view of an example of an accommodation groove according to the embodiment.

As described above, the first water stop portion 24 of the water stop member 20 extends closer to the bottom 14 than the overlapping area (sliding range 27*a*) (FIGS. 23 and 24). After completion of crimping, at least the first water stop portion 24 closer to the bottom 14 than the sliding range 27*a* and the second and the third water stop portions 25 and 26 form into the first water stop area 21 and the second and the third water stop areas 22 and 23 connected to one another in the crimp terminal 1. In other words, after completion of crimping, the part of the electric wire connecting portion 12 on the inner side than at least the overlapping area is filled with the water stop member 20. Even if the water stop member 20 in the sliding range 27*a* is scraped off, this structure can suppress entering of water between the electric wire connecting portion 12 and the core wire 51 at the distal end.

As described above, the distal end 15*a* of the first barrel piece 15 is bent in the crimp terminal 1 according to the present embodiment. With this structure, the crimp terminal 1 can suppress scraping of the water stop member 20 by an edge or other parts of the end surface of the distal end 15*a*. Furthermore, the bending reduces the sliding range 27*a* in the crimp terminal 1 according to the present embodiment. In other words, the bending facilitates formation of the first to the third water stop areas 21 to 23 connected to one another in the crimp terminal 1 according to the present embodiment. Consequently, the bending of the distal end 15*a* can improve the water stop performance in the crimp terminal 1.

The water stop member 20 slides between the first barrel piece 15 and the end of the electric wire 50 and deforms in the crimping process, thereby forming into the first to the third water stop areas 21 to 23. Because the water stop member 20 does not uniformly deform in the crimp terminal 1, the first to the third water stop areas 21 to 23 are not necessarily uniformly formed. The crimp terminal 1 still has room for improvement in the water stop performance.

The present embodiment has a structure that enables formation of the first to the third water stop areas 21 to 23 even if displacement of the water stop member 20 or other faults occurs along with deformation in crimping. The present embodiment has a groove (hereinafter, referred to as an "accommodation groove") 18 at the part to which the water stop member 20 is affixed on the inner wall surface of the electric wire connecting portion 12 (FIG. 24). The accommodation groove 18 is filled with part of the affixed water stop member 20. The water stop member 20 is caused to remain in and around the accommodation groove 18 after the crimping. To fill the accommodation groove 18 with part of the water stop member 20, the present embodiment applies pressure toward the electric wire connecting portion 12 when affixing the water stop member 20 to the electric wire connecting portion 12. The present embodiment sets the pressure to a value high enough to stuff the part of the water stop member 20 into the accommodation groove 18. The present embodiment also sets the width of the accommodation groove 18 to a value large enough to accommodate the part of the water stop member 20 by the pressure. With this structure, the water stop member 20 can remain in at least the accommodation groove 18 after the crimping.

The accommodation groove 18 is formed along the shape of the water stop member 20 and has a first groove 18A, a second groove 18B, and a third groove 18C. The first groove 18A is formed in the extending direction (first direction L) of the first water stop portion 24 at the part to which the first water stop portion 24 is affixed. The second groove 18B is formed in the extending direction (second direction W) of the second water stop portion 25 at the part to which the second water stop portion 25 is affixed. The third groove 18C is formed in the extending direction (second direction W) of the third water stop portion 26 at the part to which the third water stop portion 26 is affixed. The first water stop area 21 is formed by at least the water stop member 20 remaining in the first groove 18A. The second water stop area 22 is formed by at least the water stop member 20 remaining in the second groove 18B. The third water stop area 23 is formed by at least the water stop member 20 remaining in the third groove 18C.

The first groove 18A is formed in the overlapping area (part corresponding to the sliding range 27*a*) on the inner wall surface of the second barrel piece 16. With this structure, even if the first water stop portion 24 in the sliding range 27*a* is scraped off by the first barrel piece 15, the crimp terminal 1 can cause part of the first water stop portion 24 to remain in the first groove 18A in the sliding range 27*a*. In this example, part of the second groove 18B and part of the third groove 18C are also formed in the overlapping area (part corresponding to the sliding range 27*a*). With this structure, even if the first water stop portion 24 in the sliding range 27*a* is scraped off by the first barrel piece 15, the crimp terminal 1 can cause part of the first water stop portion 24 to remain also in the part of the second groove 18B and the part of the third groove 18C. In the overlapping area, the part of the water stop member 20 remaining in the accommodation groove 18 forms into the water stop area extending between a part closer to the terminal connecting portion 11 than the distal end position of the core wire 51 at the distal end and a part on the cover 52 side. In the overlapping area, the water stop area can suppress entering of water between the electric wire connecting portion 12 and the core wire 51 at the distal end from the space between the outer wall surface of the first barrel piece 15 and the inner wall surface of the second barrel piece 16 after completion of crimping. The water stop area formed by the water stop member 20 in the accommodation groove 18 in the overlapping area is connected to water stop areas formed by the water stop member 20 in the remaining range 27*b* at both ends. The water stop area serves as the first water stop area 21 together with the water stop areas in the remaining range 27*b*.

In the crimp terminal 1 obtained after completion of crimping, the part closer to the terminal connecting portion 11 than the distal end position of the core wire 51 at the distal end is covered with the second water stop area 22, and the part between the electric wire connecting portion 12 and the cover 52 is covered with the third water stop area 23. This structure secures the water stop performance in both parts. The accommodation groove 18 in the overlapping area simply needs to be formed at at least a part wound around the core wire 51 at the distal end on the inner wall surface of the second barrel piece 16. Even with this structure, the crimp terminal 1 can improve the water stop performance between the electric wire connecting portion 12 and the core wire 51 at the distal end after completion of crimping.

The second groove 18B extends between a part on the distal end 15*a* of the first barrel piece 15 and a part on the distal end 16*a* of the second barrel piece 16 on the side closer to the terminal connecting portion 11 than the distal end position of the core wire 51 at the distal end and on the side closer to the terminal connecting portion 11 than the serration area 17 on the inner wall surface of the core wire crimping portion 12A. In this example, the second groove 18B has a linear shape along the extending direction. Part of the second water stop portion 25 filled in the second groove 18B serves as part of components of the second water stop area 22. The part of the second water stop portion 25 can suppress entering of water between the electric wire connecting portion 12 and the core wire 51 at the distal end from the side closer to the terminal connecting portion 11 than the distal end position of the core wire 51 at the distal end.

In the accommodation groove 18, the first groove 18A and the second groove 18B are preferably connected to each other. With this structure, the first groove 18A and the second groove 18B connect the first water stop area 21 and the second water stop area 22. This structure can suppress a gap between the first water stop area 21 and the second water stop area 22, thereby improving the water stop performance. The water stop member 20 in the second groove 18B forms into part of the second water stop area 22 mainly by the second water stop portion 25 and also forms into part of the first water stop area 21 by the first water stop portion 24.

The electric wire connecting portion 12 has a protrusion 19C protruding from the inner wall surface on the side closer to the terminal connecting portion 11 than the distal end position of the core wire 51 at the distal end and the serration area 17. The protrusion 19C is formed into a rectangular parallelepiped shape and arranged along the second direction W. The protrusion 19C is provided to increase the rigidity of the electric wire connecting portion 12. In the electric wire connecting portion 12 in this example, the water stop member 20 is affixed in a manner overlapping with the top surface of the protrusion 19C. In the crimp terminal 1 according to the present embodiment, the protrusion 19C facilitates compression of the water stop member 20 in the crimping process compared with a case where the protrusion 19C is not provided. With this structure, the crimp terminal 1 increases the filling efficiency of the second water stop portion 25 in the second water stop area 22, thereby improving the water stop performance of the second water stop area 22. Because the water stop member 20 overlaps with the protrusion 19C, a part of the water stop member 20 near the protrusion 19C may possibly be separated from the inner wall surface of the plate-like electric wire connecting portion 12, resulting in displacement of the affixing position. The crimp terminal 1 according to the present embodiment has the accommodation groove 18 (the first groove 18A, the second groove 18B, and the third groove 18C) formed on the inner wall surface, thereby enabling part of the water stop member 20 to enter into the accommodation groove 18 in the affixing of the water stop member 20. The crimp terminal 1 thus can suppress displacement of the water stop member 20 even if the affixing position of the water stop member 20 overlaps with the position of the protrusion 19C. Furthermore, the crimp terminal 1 has the second groove 18B between the serration area 17 and the protrusion 19C (that is, between the distal end position of the core wire 51 at the distal end and the protrusion 19C). With this structure, the crimp terminal 1 can reduce the area where the water stop member 20 is separated, thereby increasing the filling efficiency of the second water stop portion 25 in the second water stop area 22.

The third groove 18C extends between a part on the distal end 15*a* of the first barrel piece 15 and a part on the distal end 16*a* of the second barrel piece 16 on the inner wall surface of the cover crimping portion 12B. In this example, the third groove 18C has a linear shape along the extending direction. Part of the third water stop portion 26 filled in the third groove 18C forms into a ring-shaped water stop area between the inner wall surface of the cover crimping portion 12B and the cover 52. In the crimp terminal 1, the water stop area can suppress entering of water between the electric wire connecting portion 12 and the core wire 51 at the distal end from the space between the inner wall surface of the cover crimping portion 12B and the cover 52. The water stop area serves as the third water stop area 23 together with a ring-shaped water stop area formed by the surrounding third water stop portion 26 arranged between the inner wall surface of the cover crimping portion 12B and the cover 52.

In the accommodation groove 18, the first groove 18A and the third groove 18C are preferably communicated with each other. With this structure, the first groove 18A and the third groove 18C connect the first water stop area 21 and the third water stop area 23. This structure can suppress a gap between the first water stop area 21 and the third water stop area 23, thereby improving the water stop performance. The water stop member 20 in the third groove 18C forms into the third water stop area 23 mainly by the third water stop portion 26 and also forms into part of the first water stop area 21 by the first water stop portion 24.

The third groove 18C is preferably provided in plurality. Even if the removal length of the cover 52 is changed, resulting in a shift in the position at which the cover 52 is placed, for example, the crimp terminal 1 can form the third water stop area 23 in a ring-shaped space between the electric wire connecting portion 12 and the cover 52 using at least one of the third grooves 18C. In this example, three third grooves 18C are formed with a gap interposed therebetween. The three third grooves 18C are integrated into one groove on the distal end 16*a* side. The integrated portion is connected to the first groove 18A.

As described above, the crimp terminal 1 according to the present embodiment has the first groove 18A, the second groove 18B, and the third groove 18C, thereby improving the water stop performance at the parts corresponding thereto. The crimp terminal 1 thus can suppress entering of water between the electric wire connecting portion 12 and the core wire 51 at the distal end. Consequently, the crimp terminal 1 can increase both its own durability and the durability of the electric wire 50. Especially in a case where the terminal fitting 10 and the core wire 51 are made of different types of metal materials as described above, the crimp terminal 1 can suppress electric corrosion therebetween by suppressing entering of water. The first groove 18A in this example is communicated with the second groove 18B and the third groove 18C. In other words, the accommodation groove 18 in this example is formed into a U-shape surrounding the serration area 17 (FIG. 24). In the crimp terminal 1 according to the present embodiment, the first water stop area 21 is connected to the second water stop area 22 and the third water stop area 23, thereby eliminating the gaps therebetween. With this structure, the crimp terminal 1 can further improve the water stop performance, thereby suppressing entering of water between the electric wire connecting portion 12 and the core wire 51 at the distal end more reliably. Consequently, the crimp terminal 1 can further increase both its own durability and the durability of the electric wire 50.

When the first barrel piece 15 slides along the inner wall surface of the second barrel piece 16 in crimping, the distal end 15*a* of the first barrel piece 15 may possibly get caught in the first groove 18A depending on the shapes of the distal end 15*a* and the first groove 18A. The catch may possibly cause unnecessary deformation of the first barrel piece 15 and the second barrel piece 16, thereby preventing execution of desired crimping. To address this, the first groove 18A is preferably formed into a shape that prevents the first barrel piece 15 from getting caught in it in crimping. The shape of the first groove 18A needs to be appropriately determined based on the shape of the distal end 15*a* of the first barrel piece 15 because it depends mainly on the shape of the distal end 15*a*. The first groove 18A illustrated in FIG. 24, for example, is formed into a wavy shape in which peaks and valleys are alternately formed in the extending direction.

Figure 25:
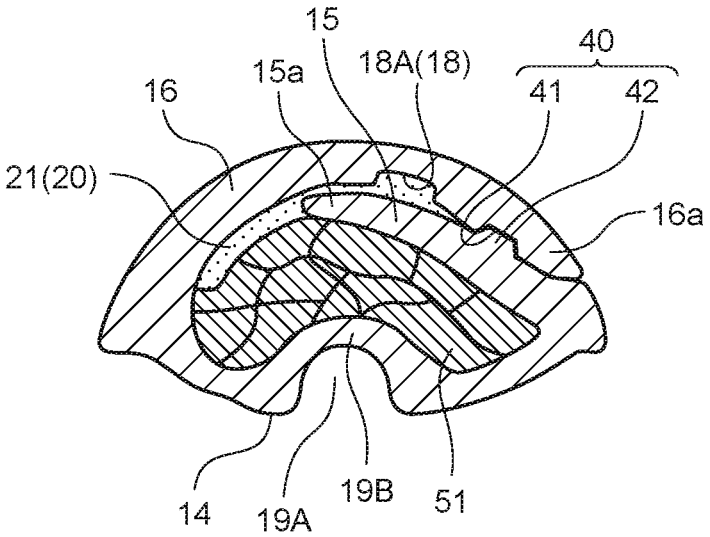
FIG. 25 is a view for explaining an engagement structure and illustrates a sectional part of the electric wire connecting portion along line Y2-Y2 in FIG. 4.

In the crimp terminal 1 crimped as described above, separation between the first barrel piece 15 and the second barrel piece 16 causes deterioration in the water stop performance. The separation may possibly weaken the electrical connection between the electric wire connecting portion 12 and the core wire 51 at the distal end. In other words, the separation between the first barrel piece 15 and the second barrel piece 16 may possibly reduce the durability of the crimp terminal 1. To address this, the crimp terminal 1 according to the present embodiment may have an engagement structure 40 between the outer wall surface of the first barrel piece 15 and the inner wall surface of the second barrel piece 16 overlapping with each other after the crimping (FIG. 25). The engagement structure 40 maintains the overlapping state. The engagement structure 40 engages the first barrel piece 15 with the second barrel piece 16 in crimping, thereby suppressing separation between the first barrel piece 15 and the second barrel piece 16 after the crimping. With the engagement structure 40, the crimp terminal 1 according to the present embodiment can suppress separation between the first barrel piece 15 and the second barrel piece 16. With the engagement structure 40, the crimp terminal 1 can suppress deterioration in the water stop performance and maintain the electrical connection between the electric wire connecting portion 12 and the core wire 51 at the distal end. Consequently, the crimp terminal 1 can increase the durability. The water stop member 20 is formed into a shape avoiding the position where the engagement structure 40 is formed.

The engagement structure 40 illustrated in FIG. 25 has a recess 41 and a protrusion 42. The recess 41 is formed on at least the outer wall surface of the first barrel piece 15 and the inner wall surface of the second barrel piece 16. The protrusion 42 is formed at a part facing the recess 41 after the crimping on the outer wall surface of the first barrel piece 15 or the inner wall surface of the second barrel piece 16 and fitted into the recess 41. At least a pair of the recess 41 and the protrusion 42 is provided. The recess 41 of the engagement structure 40 may be formed on one of the outer wall surface of the first barrel piece 15 and the inner wall surface of the second barrel piece 16 before crimping, and the protrusion 42 may be formed on the other before crimping. Alternatively, the recess 41 of the engagement structure 40 may be formed on one of the outer wall surface of the first barrel piece 15 and the inner wall surface of the second barrel piece 16 before crimping, and the protrusion 42 may be formed as follows: part of the outer wall surface of the first barrel piece 15 or part of the inner wall surface of the second barrel piece 16 facing the recess 41 is deformed by the pressing force applied between the outer wall surface and the inner wall surface in crimping, and the deformed part enters into the recess 41 to form into the protrusion 42. Still alternatively, the protrusion 42 of the engagement structure 40 may be formed on one of the outer wall surface of the first barrel piece 15 and the inner wall surface of the second barrel piece 16 before crimping, and the recess 41 may be formed on the other by the pressing force applied between the outer wall surface and the inner wall surface in crimping.

The recess 41 in this example is formed by pressing performed before crimping. In this example, when the plate-like electric wire connecting portion 12 is formed by pressing, the recess 41 is also formed on the distal end 16*a* of the second barrel piece 16 (FIGS. 5 and 6 and other figures). The recess 41 in this example has a rectangular parallelepiped shape with its longitudinal direction along the extending direction (first direction L) of the core wire 51 at the distal end. Two recesses 41 are arranged side by side in the extending direction. If the recess 41 is formed by pressing, the side walls thereof may possibly be inclined such that the area of the opening is larger than that of the bottom. To address this, the distal end 16*a* is preferably pressed by a die from the outer wall surface side with another die placed in the recess 41 in the pressing, thereby eliminating or reducing the inclination of the side walls of the recess 41. The recess 41 formed by the pressing and its periphery on the inner wall surface of the second barrel piece 16 have higher hardness than other parts due to work hardening. In crimping, when the first crimper 113A presses the distal end 16*a* of the second barrel piece 16 onto the first barrel piece 15, part of the outer wall surface of the first barrel piece 15 having lower hardness enters into the recess 41 having higher hardness, thereby forming into the protrusion 42. The engagement structure 40 according to the present embodiment is formed as described above.

The crimp terminal and the terminal crimping device according to the present embodiment have the recess and the protrusion on the bottom and the protrusion on the recessed surface, thereby enabling the protrusion to remain on the inner wall surface of the bottom after crimping process. The protrusion on the bottom can increase the contact area between the core wire at the distal end and the electric wire connecting portion and secure the adhesion strength therebetween. The crimp terminal and the terminal crimping device inserts the protrusion on the recessed surface into the recess during the crimping process, thereby enabling the protrusion on the bottom to remain while performing the crimping process. Consequently, the crimp terminal and the terminal crimping device have high productivity and can secure the adhesion strength between the electric wire connecting portion and the core wire.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimp terminal comprising:

a terminal connecting portion electrically connected to a counterpart terminal;

an electric wire connecting portion electrically connected to an end of an electric wire placed on an inner wall surface side by crimping process performed with the electric wire connecting portion sandwiched between a first die and a second die; and a coupling portion that couples the terminal connecting portion and the electric wire connecting portion, wherein the electric wire connecting portion is divided into a bottom placed on a recessed surface of the first die and on which the end of the electric wire is placed during the crimping process, a first barrel piece extending from a first end of the bottom and wound around the end of the electric wire, and a second barrel piece extending from a second end of the bottom and wound around the end of the electric wire, and the bottom has, in an area on which a core wire at a distal end of the electric wire is placed, a recess formed on an outer wall surface on the recessed surface side and into which a protrusion formed on the recessed surface is inserted during the crimping process, and a protrusion on the inner wall surface formed along with formation of the recess.

2. The crimp terminal according to claim 1, wherein the recess and the protrusion on the bottom and the protrusion on the recessed surface are formed into respective shapes such that the protrusion on the bottom protrudes from the inner wall surface of the bottom even when the core wire compresses the protrusion on the bottom during the crimping process.

3. The crimp terminal according to claim 1, wherein a size of an internal space of the recess is smaller than a size of the protrusion on the recessed surface so that the protrusion on the recessed surface is capable of being thrusted into the recess during the crimping process, to push out the protrusion on the bottom toward the core wire side.

4. The crimp terminal according to claim 2, wherein a size of an internal space of the recess is smaller than a size of the protrusion on the recessed surface so that the protrusion on the recessed surface is capable of being thrusted into the recess during the crimping process, to push out the protrusion on the bottom toward the core wire side.

5. The crimp terminal according to claim 1, wherein the recess and the protrusion on the bottom are formed in a core wire holding area on which the core wire is held when the core wire holding area is formed on the inner wall surface of the bottom.

6. The crimp terminal according to claim 2, wherein the recess and the protrusion on the bottom are formed in a core wire holding area on which the core wire is held when the core wire holding area is formed on the inner wall surface of the bottom.

7. The crimp terminal according to claim 3, wherein the recess and the protrusion on the bottom are formed in a core wire holding area on which the core wire is held when the core wire holding area is formed on the inner wall surface of the bottom.

8. A terminal crimping device comprising:

a terminal supplying device that transfers a crimp terminal to a crimping position at which the crimp terminal is crimped to an electric wire;

a crimping device that crimps the crimp terminal transferred to the crimping position to an end of the electric wire using a first die and a second die; and a driving device that reduces a gap between the first die and the second die during crimping process and increases the gap between the first die and the second die after the crimping process is completed, wherein the crimp terminal includes a terminal connecting portion electrically connected to a counterpart terminal, an electric wire connecting portion electrically connected to the end of the electric wire placed on an inner wall surface side by the crimping process, and a coupling portion that couples the terminal connecting portion and the electric wire connecting portion, the electric wire connecting portion is divided into a bottom placed on a recessed surface of the first die and on which the end of the electric wire is placed during the crimping process, a first barrel piece extending from a first end of the bottom and wound around the end of the electric wire, and a second barrel piece extending from a second end of the bottom and wound around the end of the electric wire, and the bottom has, in an area on which a core wire at a distal end of the electric wire is placed, a recess formed on an outer wall surface on the recessed surface side and into which a protrusion formed on the recessed surface is inserted during the crimping process, and a protrusion on the inner wall surface formed along with formation of the recess.

9. The terminal crimping device according to claim 8, wherein the recess and the protrusion on the bottom and the protrusion on the recessed surface are formed into respective shapes such that the protrusion on the bottom protrudes from the inner wall surface of the bottom even when the core wire compresses the protrusion on the bottom during the crimping process.

10. The terminal crimping device according to claim 8, wherein a size of the protrusion on the recessed surface is larger than a size of an internal space of the recess so that the protrusion on the recessed surface is capable of being thrusted into the recess during the crimping process, to push out the protrusion on the bottom toward the core wire side.

11. The terminal crimping device according to claim 9, wherein a size of the protrusion on the recessed surface is larger than a size of an internal space of the recess so that the protrusion on the recessed surface is capable of being thrusted into the recess during the crimping process, to push out the protrusion on the bottom toward the core wire side.

* * * * *